US011441865B2

(12) United States Patent
Barrett et al.

(10) Patent No.: US 11,441,865 B2
(45) Date of Patent: Sep. 13, 2022

(54) INTERRUPTED SEMI-AUTOMATIC ACTION FOR FIREARMS

(71) Applicant: Sturm, Ruger & Company, Inc., Southport, CT (US)

(72) Inventors: Jonathan Barrett, Georges Mills, NH (US); Jonathan Philip Mather, Grafton, NH (US)

(73) Assignee: Sturm, Ruger & Company, Inc.

( * ) Notice: Subject to any disclaimer, the term of this patent is extended or adjusted under 35 U.S.C. 154(b) by 351 days.

(21) Appl. No.: 16/710,620

(22) Filed: Dec. 11, 2019

(65) Prior Publication Data

US 2020/0182575 A1 Jun. 11, 2020

Related U.S. Application Data

(60) Provisional application No. 62/778,070, filed on Dec. 11, 2018.

(51) Int. Cl.
*F41A 19/45* (2006.01)
*F41A 17/42* (2006.01)
(Continued)

(52) U.S. Cl.
CPC ..... *F41A 19/45* (2013.01); *F41A 19/10* (2013.01); *F41A 19/12* (2013.01); *F41A 19/14* (2013.01); *F41A 19/47* (2013.01); *F41A 17/42* (2013.01)

(58) Field of Classification Search
CPC ..... F41A 17/36; F41A 17/42
See application file for complete search history.

(56) References Cited

U.S. PATENT DOCUMENTS 1,786,536 A * 12/1930 Holek ..... F41A 19/46 89/139
2,422,853 A 6/1947 Reising
(Continued)

FOREIGN PATENT DOCUMENTS

CN 207300040 U 5/2018
EP 3132223 B1 7/2018
(Continued)

OTHER PUBLICATIONS

International Search Report and Written Opinion issued in International Application No. PCT/US19/65625 dated Jun. 19, 2020.
(Continued)

*Primary Examiner* — Gabriel J. Klein
(74) *Attorney, Agent, or Firm* — The Belles Group, P.C.

(57) ABSTRACT forward closed breech position in battery with the barrel and rearward open breech position, a cockable hammer controlled by a trigger, and a bolt release mechanism operably interacting with the bolt. The mechanism may comprise a user-actuated release button and spring-biased disconnect lever coupled thereto and selectively engageable with the hammer. Upon firing, the bolt travels rearward under recoil contacting and partially rotating the disconnect lever to engage the hammer, while simultaneously engaging the hammer which holds the bolt rearward. Actuating the release button fully rotates the disconnect lever to disengage the hammer from the bolt which returns to its forward position via a recoil spring to reclose the breech. A dual interlock safety in one position provided by the release mechanism prevents pulling the trigger and in another position prevents actuating the release button.

32 Claims, 34 Drawing Sheets

(51) Int. Cl.

| | |
|---|---|
| ***F41A 19/10*** | (2006.01) |
| ***F41A 19/12*** | (2006.01) |
| ***F41A 19/14*** | (2006.01) |
| ***F41A 19/47*** | (2006.01) |

(56) References Cited

U.S. PATENT DOCUMENTS

| | | | | |
|---|---|---|---|---|
| 2,491,218 | A * | 12/1949 | Sefried | F41A 9/18 89/138 |
| 3,155,004 | A * | 11/1964 | Jennie | F41A 19/16 89/128 |
| 4,056,038 | A * | 11/1977 | Rath | F41A 5/18 89/128 |
| 4,057,003 | A | 11/1977 | Atchisson | |
| 4,433,610 | A | 2/1984 | Tatro | |
| 4,445,292 | A | 5/1984 | Martin | |
| 4,455,919 | A * | 6/1984 | Osborne | F41A 17/38 89/138 |
| 7,261,029 | B1 | 8/2007 | Davis | |
| 7,562,614 | B2 | 7/2009 | Polston | |
| 7,806,039 | B1 | 10/2010 | Gomez | |
| 8,656,620 | B2 | 2/2014 | Hankel et al. | |
| 8,695,477 | B2 | 4/2014 | Esch | |
| 8,985,005 | B1 | 3/2015 | Dubois et al. | |
| 8,985,006 | B1 | 3/2015 | Christensen et al. | |
| 9,016,187 | B2 | 4/2015 | Findlay et al. | |
| 9,057,574 | B2 | 6/2015 | Mcclave | |
| 9,222,746 | B2 | 12/2015 | Doll et al. | |
| 9,347,737 | B2 | 5/2016 | Troy et al. | |
| 9,638,481 | B1 | 5/2017 | Marano et al. | |
| 9,683,800 | B2 | 6/2017 | Sewell, Jr. et al. | |
| 10,401,102 | B1 * | 9/2019 | Carroll | F41A 3/68 |
| 11,015,893 | B2 * | 5/2021 | Robinson | F41A 17/42 |
| 11,187,475 | B2 * | 11/2021 | Romano | F41A 3/66 |
| 2017/0045318 | A1 | 2/2017 | Verney-Carron | |
| 2017/0138681 | A1 | 5/2017 | Norton | |
| 2017/0160033 | A1 | 6/2017 | Schmid et al. | |
| 2017/0370664 | A1 | 12/2017 | Popikov et al. | |
| 2018/0100714 | A1 | 4/2018 | Borders et al. | |
| 2018/0172374 | A1 | 6/2018 | Lupher et al. | |
| 2019/0072349 | A1 | 3/2019 | Verney-Carron | |
| 2019/0093971 | A1 | 3/2019 | Verney-Carron | |

FOREIGN PATENT DOCUMENTS

| | | | |
|---|---|---|---|
| FR | 2868155 | B1 | 9/2005 |
| WO | WO2017158256 | A1 | 9/2017 |

OTHER PUBLICATIONS

Instruction Manual for Ruger Mini-14 Ranch & Mini Thirty Rifles (2018) Sturm, Ruger & Co., Inc., , pp. 1-60.

* cited by examiner

INTERRUPTED SEMI-AUTOMATIC ACTION FOR FIREARMS

CROSS-REFERENCE TO RELATED APPLICATIONS

The present application claims priority to U.S. Provisional Application No. 62/778,070 filed Dec. 11, 2018, which is incorporated herein by reference in its entirety.

BACKGROUND

The present invention generally relates to semi-automatic actions of firearms, and more particularly to an interrupted-type semi-automatic action for a firearm.

Semi-automatic firearms are defined by an action that fires a cartridge, automatically ejects the spent brass, and then loads another cartridge into the chamber for every pull of the trigger. This action type is desirable for its fast operation and minimal input required by the operator, but is banned by law in some locations.

To comply with such firearm restrictions, the intended operation of an interrupted semi-automatic action is such that when the trigger is pulled, the action fires the cartridge, automatically ejects the spent brass, and then locks the bolt in the open/rearward breech position. The action remains in the open breech position until the operator releases the trigger, and then intervenes to manually release the bolt back into battery with the barrel, which is its former ready-to-fire forward closed breech position. As the bolt travels into battery, it automatically loads another new cartridge into the chamber of the barrel from the magazine. This action must be repeated to cycle the action each time the firearm is discharged.

Prior designs of interrupted actions have various configurations of actuator mechanisms for holding the hammer rearward and manually releasing the bolt. Some designs may be cumbersome for users, are not compact adversely affecting the appearance and handling of the firearm, or have complex mechanisms.

Improvements in interrupted actions for firearms is desired.

SUMMARY OF THE INVENTION

The present invention provides a non-limiting embodiment of an improved interrupted semi-automatic action ("interrupted action" for short) with bolt release mechanism for a firearm which not only overcomes the foregoing detriments of past interrupted action designs, but also provides a dual acting safety feature in the form of a trigger interlock. In a first position, the trigger interlock safety prevents the bolt from being released while in the rearward open breech position via actuating the bolt release mechanism until the user or operator fully releases the trigger after being pulled. This prevents the firearm from automatically firing unintentionally if the bolt were released while the trigger was still pulled. In a second position, the trigger interlock safety prevents the trigger from being actuated until the bolt release actuator is returned by the user to its unactuated position after the bolt is released. Both safety features are provided by a combination of interacting features of the present bolt release mechanism and trigger, as further described herein.

To create the interruption in the cycling of the action, the present hammer is designed to catch the bolt whenever it is in the rearward open breech position. The hammer is biased upwards against the underside of the bolt via spring force. When the bolt is in the rear position, a catch feature such as a retention notch in one embodiment on the underside of the bolt allows for the hammer to rotate up while still cocked into the notch and catch/arrest the forward travel of the bolt to interrupt the action. This operation contrasts to regular full semi-automatic actions which automatically releases the bolt after a fresh ammunition cartridge has uploaded into the breech area from the spring loaded magazine. In order to then release the present bolt forward back into battery requires the hammer to be pulled down out of this notch by manual intervention, which defines an interrupted action type firing system. In one non-limiting embodiment, this may be achieved by manual actuation of the bolt release mechanism.

The bolt release mechanism in one embodiment may generally comprise the combination of a spring-loaded disconnect lever selectively engageable with the hammer when in the rearward cocked position holding the bolt rearward as stated above, and a user-operated actuator which can be a pivotably slideable release button in one non-limiting embodiment operably interacting with the lever. In one embodiment, the release button may be mounted at the rear of the receiver axially inline with the firearm and arranged for engagement by the user's thumb via an upward action. This mounting arrangement advantageously provides a compact design and aesthetically pleasing appearance of the bolt release mechanism without obtrusive lateral projections which can interfere with handling and storage of the firearm. When actuated, the present release button operates to rotate the disconnect lever downwards, which in turn breaks the temporary engagement between the hammer and bolt. The bolt is released forward back into battery with the barrel to close the breech for the next shot.

The release button may further comprise a trigger block which forms the above mentioned safety feature that prevents the button from being actuated when the trigger is pulled, or visa-versa. The trigger block may comprise a blocking protrusion on the trigger which is selectively engageable with a locking feature on the release button depending on the state of the trigger (i.e. pulled or not).

The present interrupted action may be used in a long gun such as without limitation a centerfire rifle in one implementation; however, the present interrupted action may be used in other types of firearms with comparable applicability such as for example shotguns. Accordingly, the interrupted action is not limited to use in any particular type of firearm.

In one aspect, a firearm with interrupted action comprises: a longitudinal axis; a receiver defining a longitudinally-extending cavity; a barrel supported by the receiver; a trigger movably mounted to the receiver; a bolt slideably mounted in the cavity of the receiver for movement between a forward position in battery with the barrel and a rearward position; a cockable hammer operably interacting with the trigger, the hammer pivotably movable about a pivot axis between a rear cocked position and a forward fire position via pulling the trigger; the hammer configured and operable to retain the bolt in the rearward position after a trigger pull to fire the firearm; and a bolt release mechanism operably interacting with the bolt, the bolt release mechanism comprising a user-actuated release button and a spring-biased disconnect lever coupled to the release button; wherein actuating the release button when the bolt is in the rearward position releases the bolt.

In another aspect, a firearm with interrupted action comprises: a longitudinal axis; a receiver defining a longitudinally-extending cavity; a barrel supported by the receiver; a bolt slideably mounted in the cavity of the receiver for movement between a forward position in battery with the barrel and a rearward position; a hammer pivotably movable about a pivot axis between a rear cocked position and a forward fire position, the hammer operably engageable with the bolt after firing the firearm to retain the bolt in the rearward position; a trigger comprising a sear protrusion operably engaged with the hammer to retain the hammer in the rear cocked position; and a user-actuated bolt release mechanism configured to selectively engage the hammer; wherein actuating the bolt release mechanism when the hammer is retaining the bolt in the rearward position rotates the hammer which releases the bolt.

In another aspect, a firearm with interrupted action comprises: a longitudinal axis; a receiver defining a longitudinal cavity; a barrel supported by the receiver; a bolt slideably movable in the longitudinal cavity of the receiver between a forward position in battery with the barrel and a rearward position; a trigger operable to fire the firearm; a hammer pivotably movable about a pivot axis between a rear cocked position and a forward fire position, the hammer operably engageable with the bolt after firing the firearm to retain the bolt in the rearward position; a user-actuated bolt release mechanism configured to selectively engage the hammer; the bolt release mechanism comprising a user-actuated release button and a disconnect lever operably interacting with the hammer; an operating spring biasing the disconnect lever into an upward position protruding at least partially into the longitudinal cavity of the receiver; wherein when the bolt moves from the forward position to the rearward position, the bolt engages and pushes the disconnect lever downwards into engagement with the hammer which is held in the cocked position by the disconnect lever; wherein actuating the bolt release mechanism when the hammer is retaining the bolt in the rearward position rotates the hammer which releases the bolt.

In another aspect, a firearm with interrupted action including a trigger interlock safety comprises: a longitudinal axis; a receiver defining a longitudinal cavity; a barrel supported by the receiver; a bolt slideably movable in the longitudinal cavity of the receiver between a forward position in battery with the barrel and a rearward position; a hammer pivotably movable about a pivot axis between a rear cocked position and a forward fire position, the hammer operably engageable with the bolt after firing the firearm to retain the bolt in the rearward position; a user-actuated bolt release mechanism configured to selectively engage the hammer, the bolt release mechanism when actuated movable to return the bolt to its forward position when the hammer is retaining the bolt in the rearward position; a movable trigger operable to fire the firearm, the trigger comprising a trigger block protrusion selectively engageable with the bolt release mechanism; the trigger and bolt release mechanism cooperatively configured to form the trigger interlock safety; wherein the trigger interlock safety is operable such that when the bolt release mechanism is in a first actuated position, the trigger cannot be moved to a pulled state.

A method for operating a firearm with an interrupted action is provided. The method includes: providing a firearm including a receiver, a barrel supported by the receiver, a bolt in a forward closed breech position in battery with the barrel, a hammer movable between a rearward cocked position and a spring-biased forward fire position for discharging the firearm, a trigger operable to restrain the hammer in the rearward cocked position, and a bolt release mechanism comprising a user-movable release button and a disconnect lever pivotably coupled to the release button; pulling the trigger which moves from a forward position to a rearward position; moving the hammer from the rearward cocked position to the forward fire position to discharge the firearm; automatically cycling the bolt rearward under recoil to an open breech position upon discharge of the firearm; restraining the bolt in the rear open breech position with the hammer; moving the release button in an upward direction which correspondingly moves the disconnect lever in a downward direction; displacing the hammer downwards with and by the movement of the disconnect lever; and disengaging the hammer from the bolt which is released and travels forward back to the closed breech position.

In various embodiments, the method further includes any or all of the following. The bolt simultaneously engaging the disconnect lever and hammer. The step of automatically cycling the bolt rearward further comprises engaging the bolt with the disconnect lever which rotates the disconnect lever downwards to contact the hammer without releasing the bolt by breaking engagement between the hammer and bolt. The step of automatically cycling the bolt reward comprises tilting the bolt relative to a longitudinal axis of the firearm defined by the barrel to engage the disconnect lever. The step of pulling the trigger simultaneously includes engaging a portion of the trigger with the release button which blocks movement of the release button. The trigger comprises a trigger block protrusion which engages a locking recess in the release button to block movement of the release button. The step of moving the release button is preceded by a step of releasing the trigger which disengages the trigger block protrusion from the locking recess of the release button which allows movement of the release button upwards. The step of moving the release button upwards after releasing the trigger includes simultaneously blocking movement of the trigger while the release button remains upward to prevent a second trigger pull. The method includes moving the release button downwards which unblocks the trigger for the second trigger pull. The step of pulling the trigger further comprises disengaging a sear protrusion of the trigger from the hammer which is configured to hold the hammer in the rearward cocked position when the trigger is in the forward position.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The features of the exemplary embodiments will be described with reference to the following drawings where like elements are labeled similarly, and in which:

All drawings are schematic and not necessarily to scale. Parts shown and/or given a reference numerical designation in one figure may be considered to be the same parts where they appear in other figures without a numerical designation for brevity unless specifically labeled with a different part number and described herein. Any references herein to a whole figure number (e.g. FIG. 1) shall be construed to be a reference to all subpart figures in the group with an alphabetical suffix (e.g. FIGS. 1A, 1B, etc.) unless otherwise indicated.

DETAILED DESCRIPTION OF EMBODIMENTS

Figure 1:
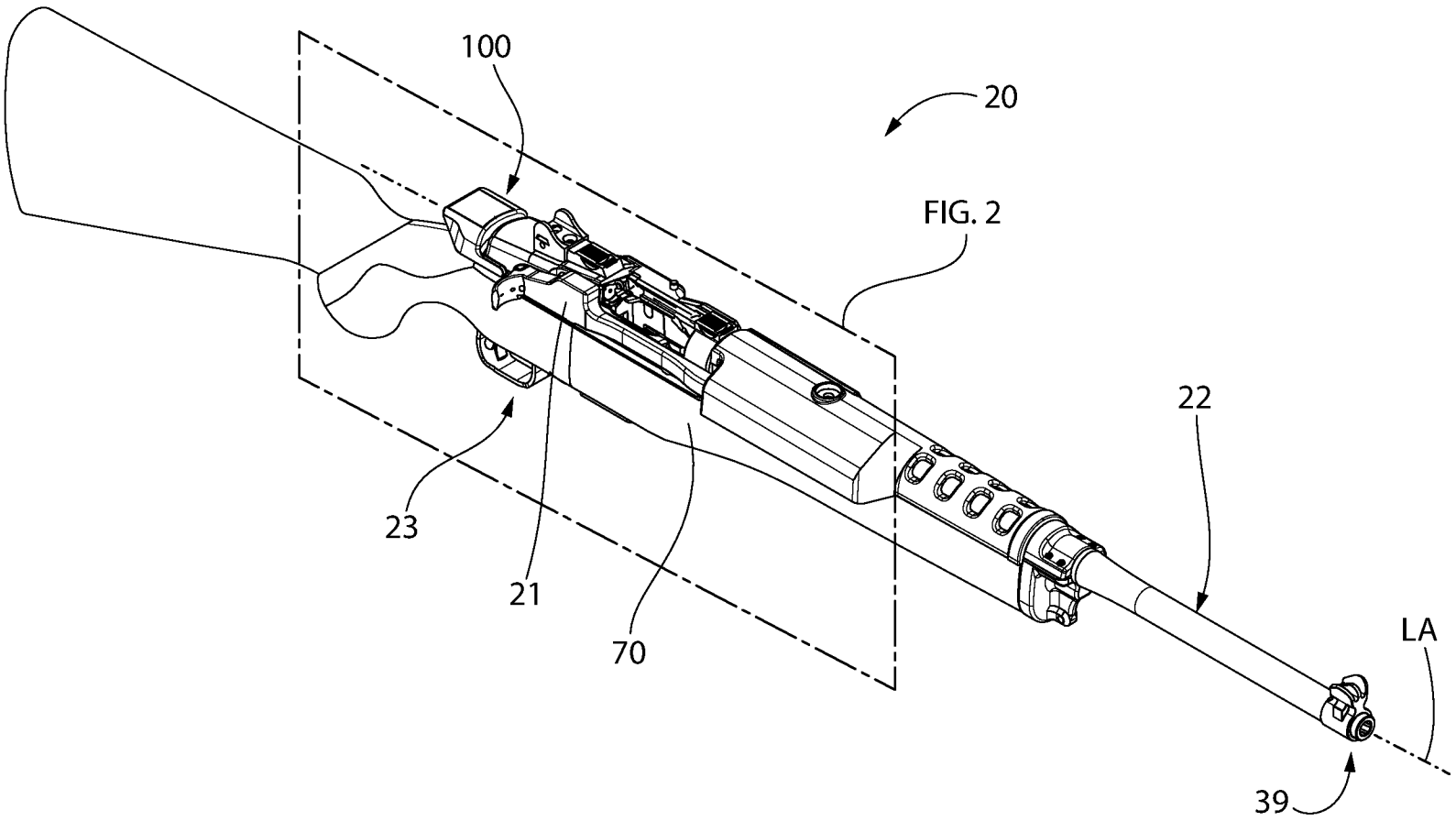
FIG. 1 is a top perspective view of a firearm in the form of a rifle having an interrupted action according to the present disclosure.
Figure 2:
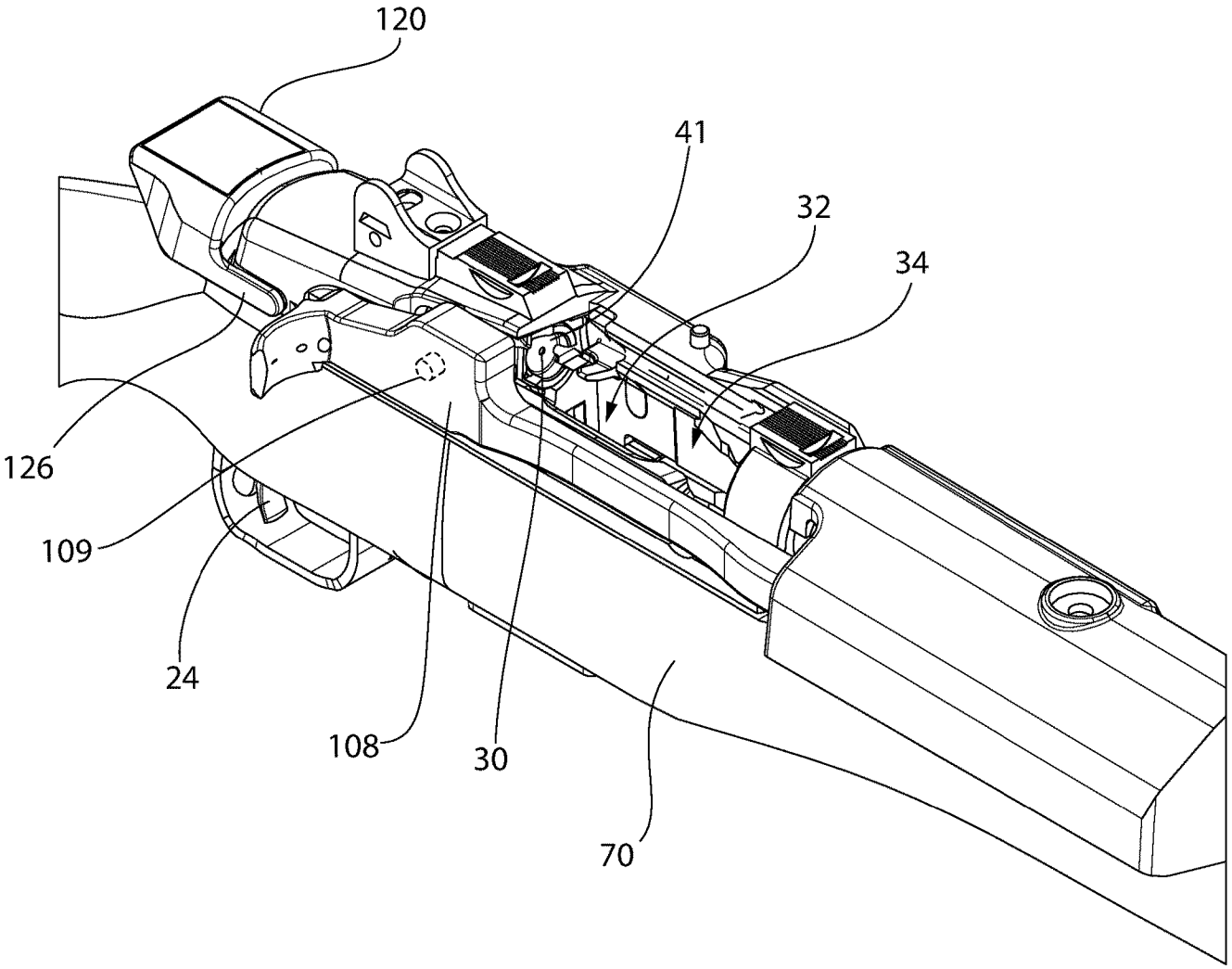
FIG. 2 is an enlarged detail taken from FIG. 1.
Figure 3:
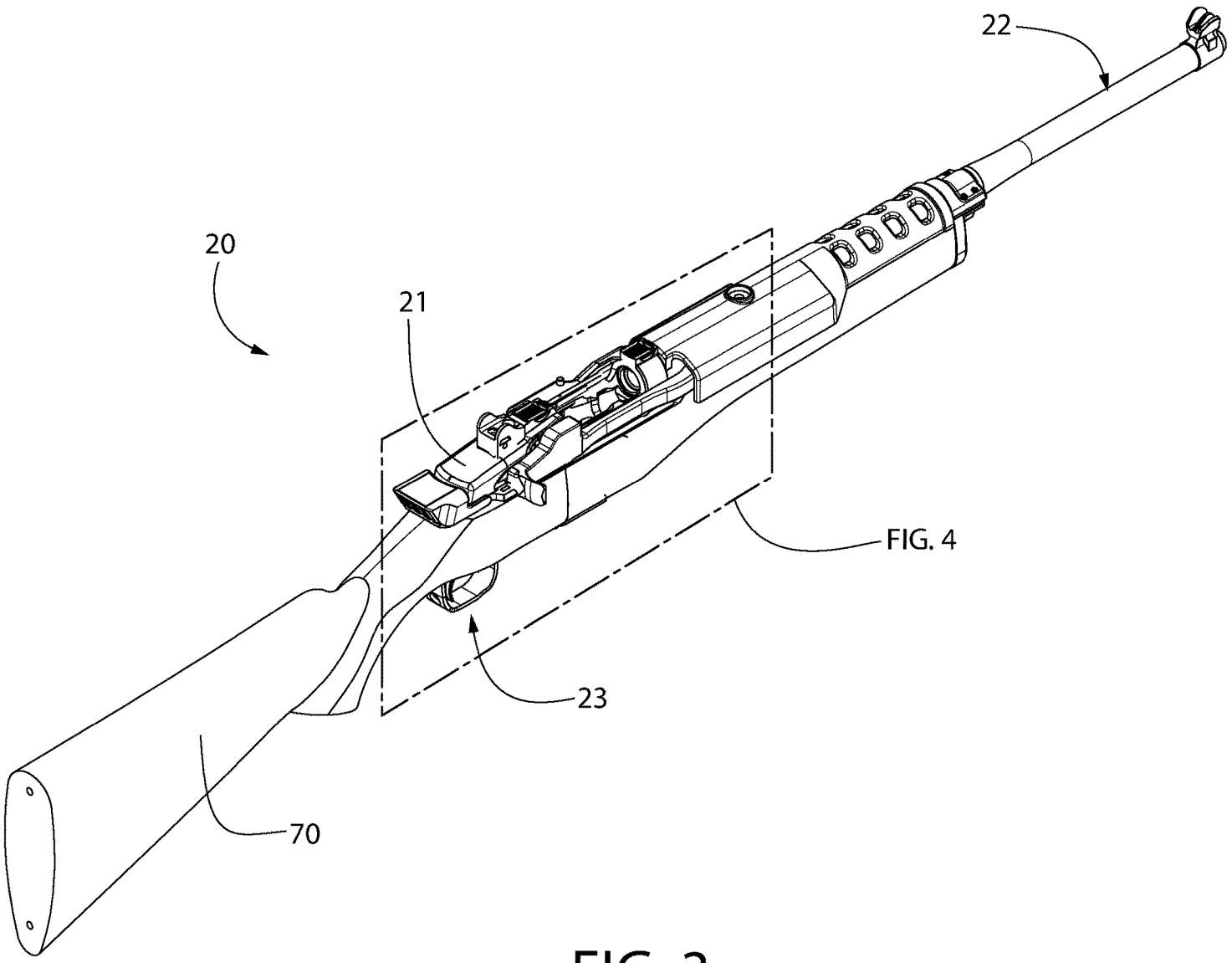
FIG. 3 is a rear perspective view of the firearm of FIG. 1.
Figure 4:
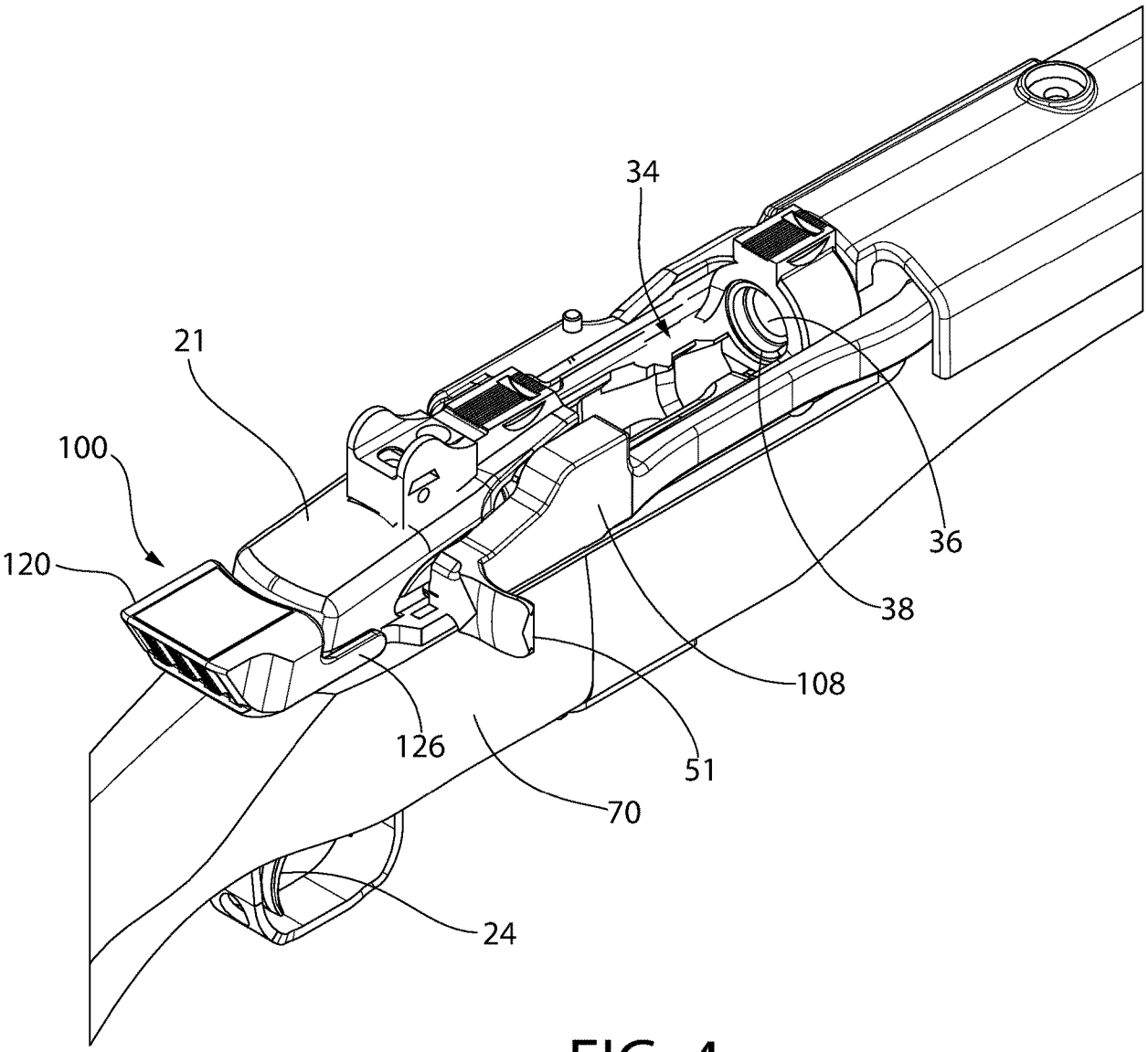
FIG. 4 is an enlarged detail taken from FIG. 3.
Figure 5:
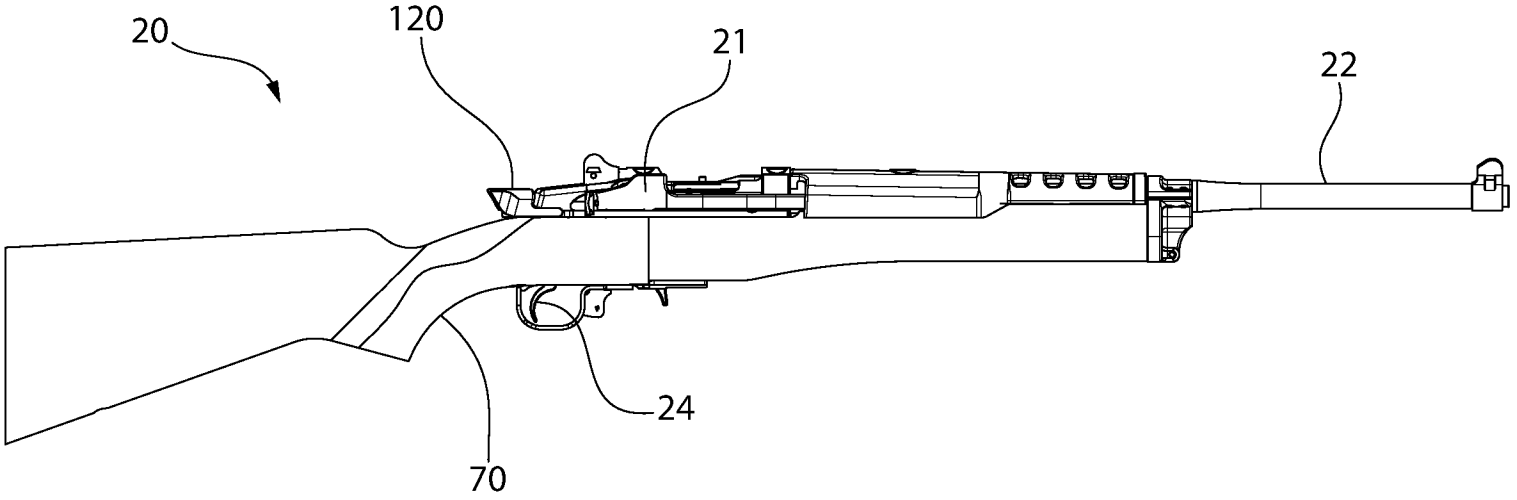
FIG. 5 is a right side view of the firearm of FIG. 1.
Figure 6:
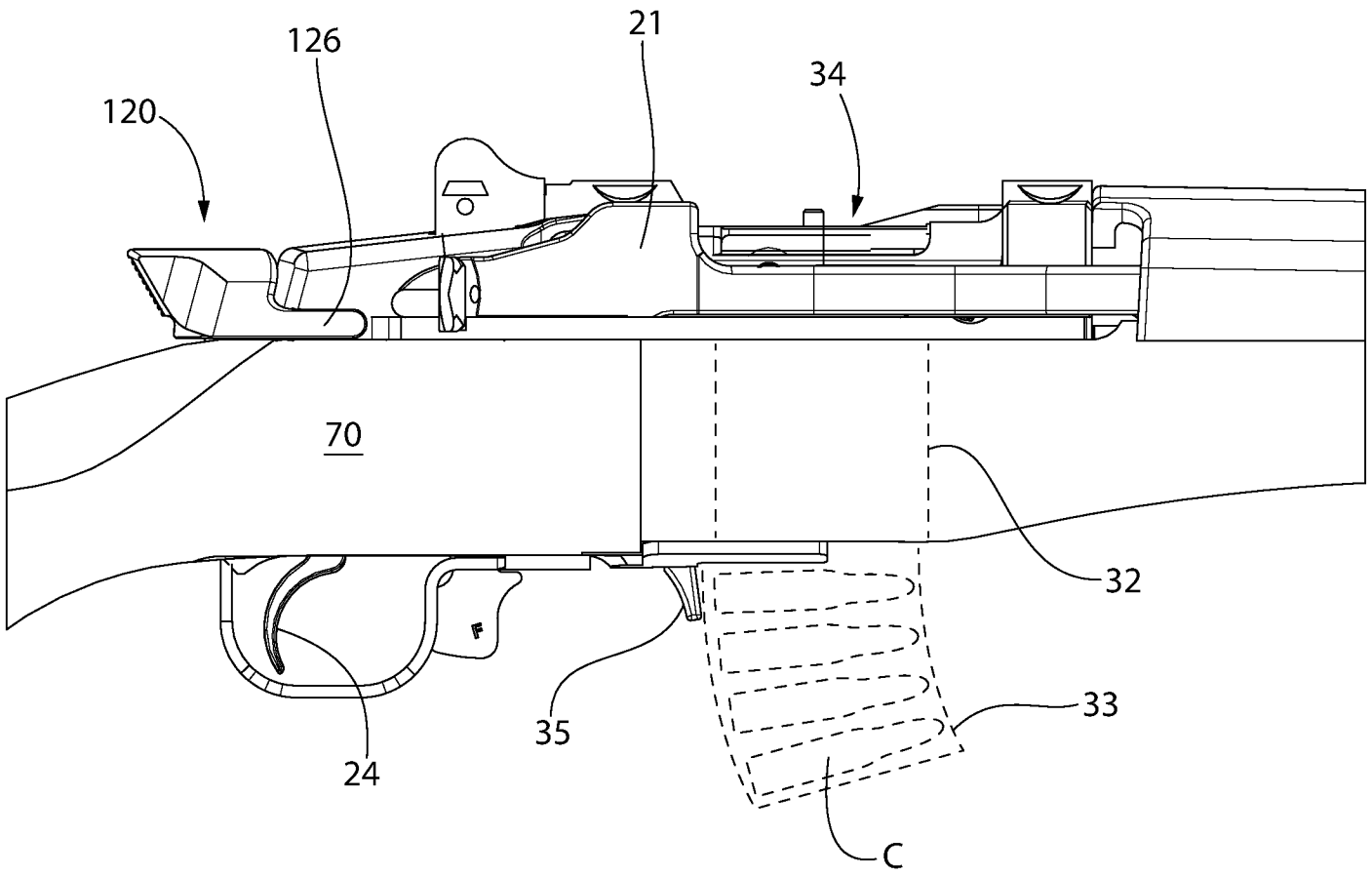
FIG. 6 is an enlarged view of the breech area thereof.
Figure 7:
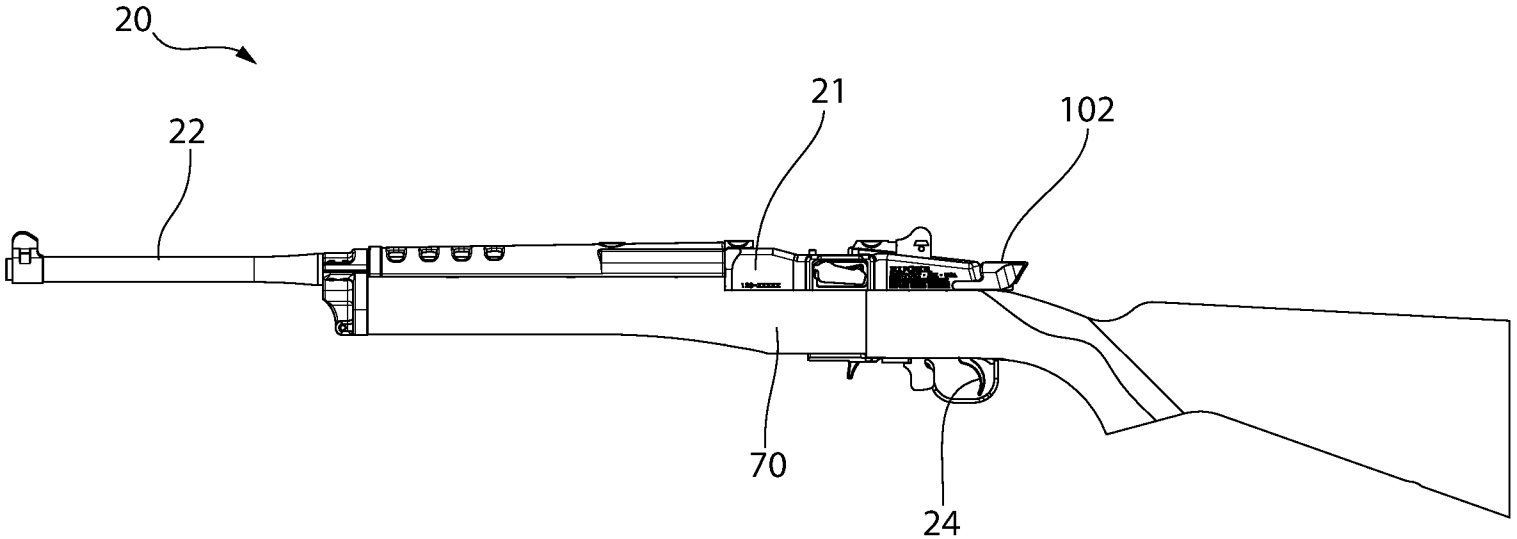
FIG. 7 is a left side view of the firearm of FIG. 1.
Figure 8:
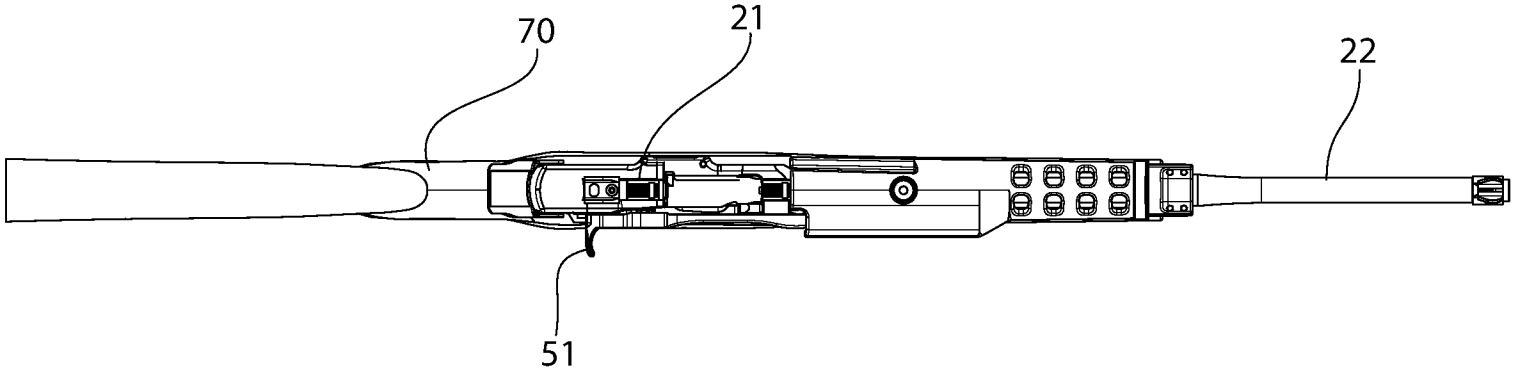
FIG. 8 is a top view thereof.
Figure 9:
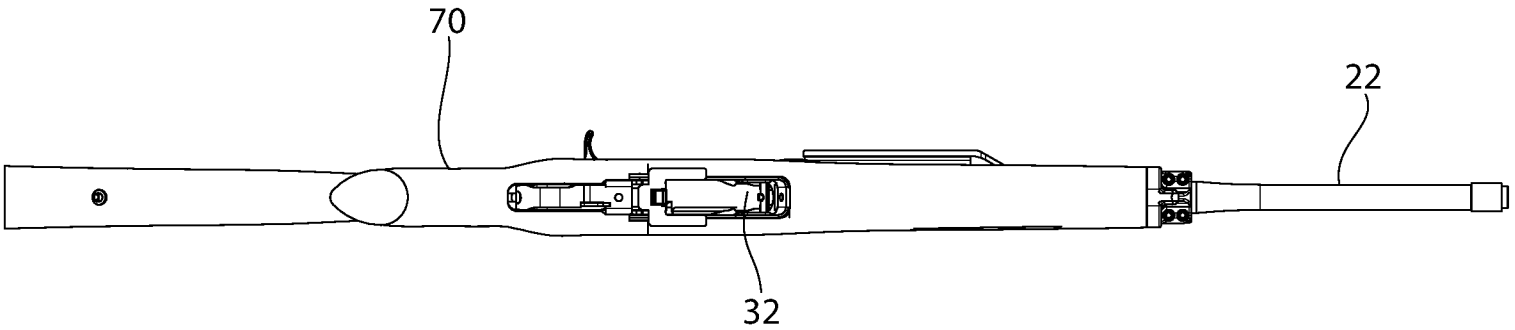
FIG. 9 is a bottom view thereof.
Figure 10:
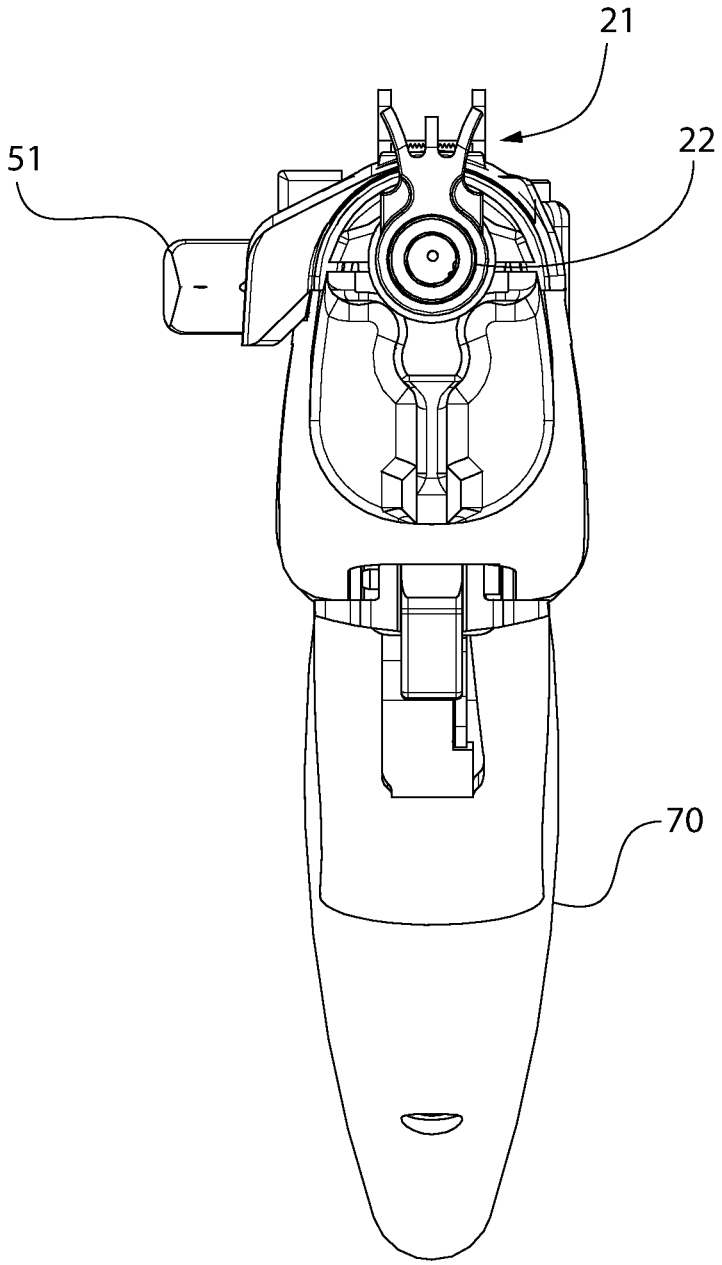
FIG. 10 is a front view thereof.
Figure 11:
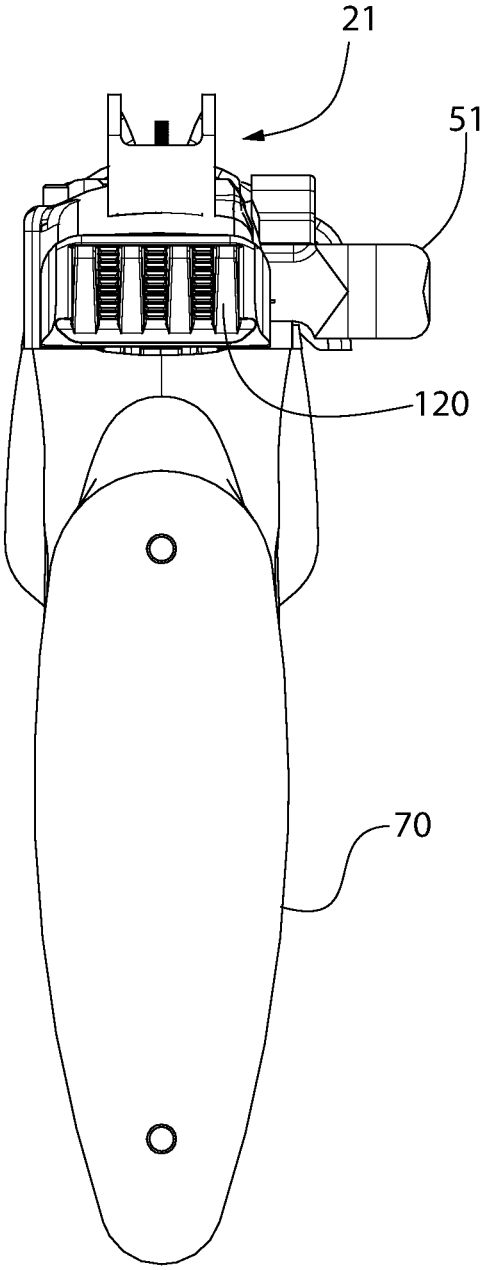
FIG. 11 is a rear view thereof.
Figure 12:
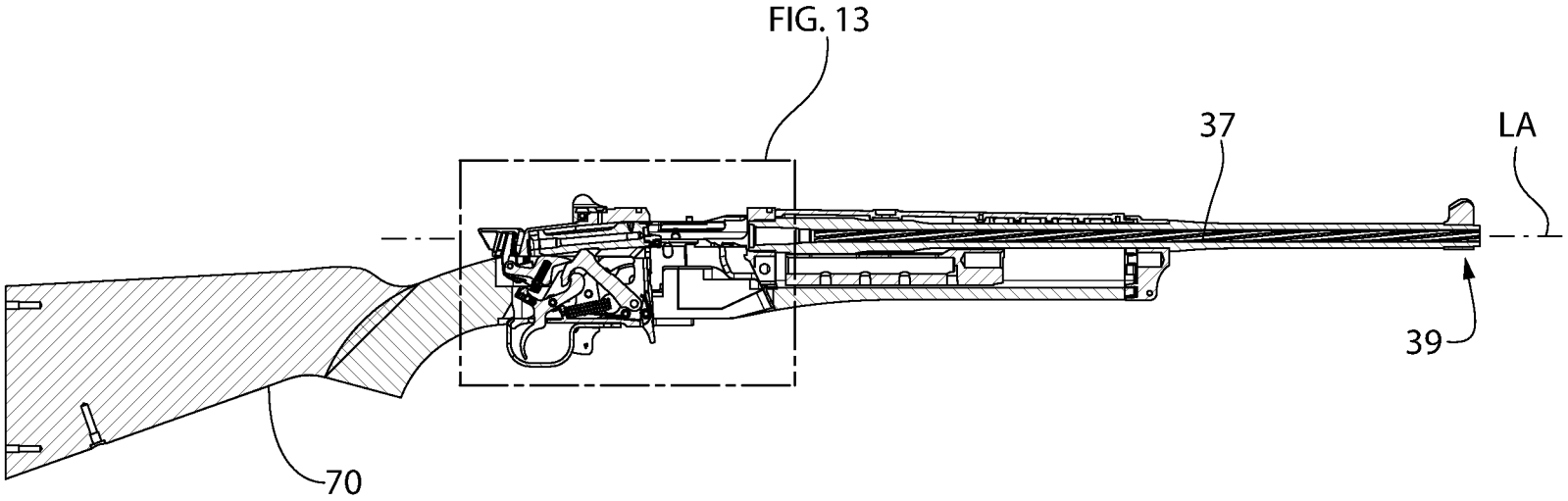
FIG. 12 is a right cross-sectional view thereof.
Figure 13:
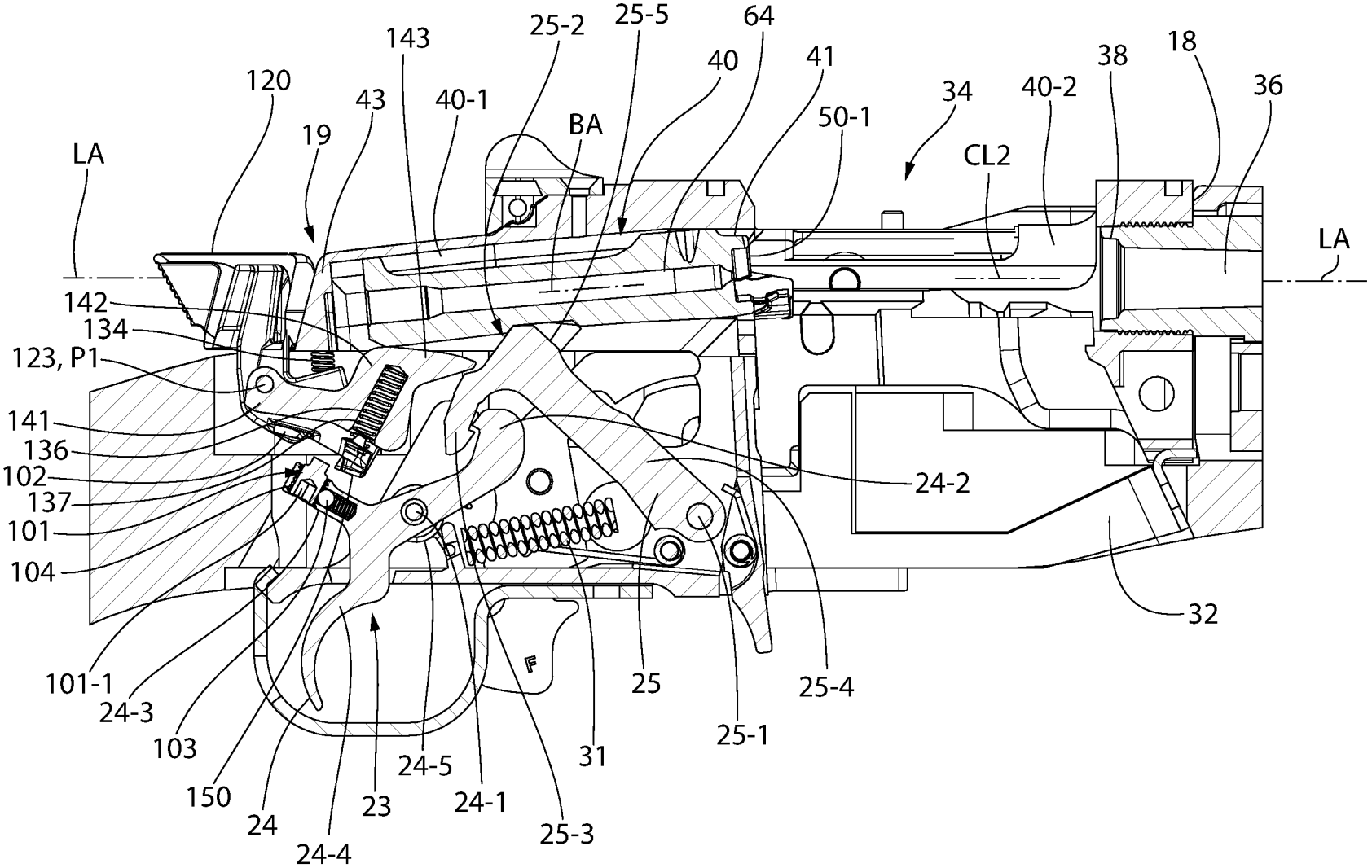
FIG. 13 is an enlarged detail taken from FIG. 12.
Figure 14:
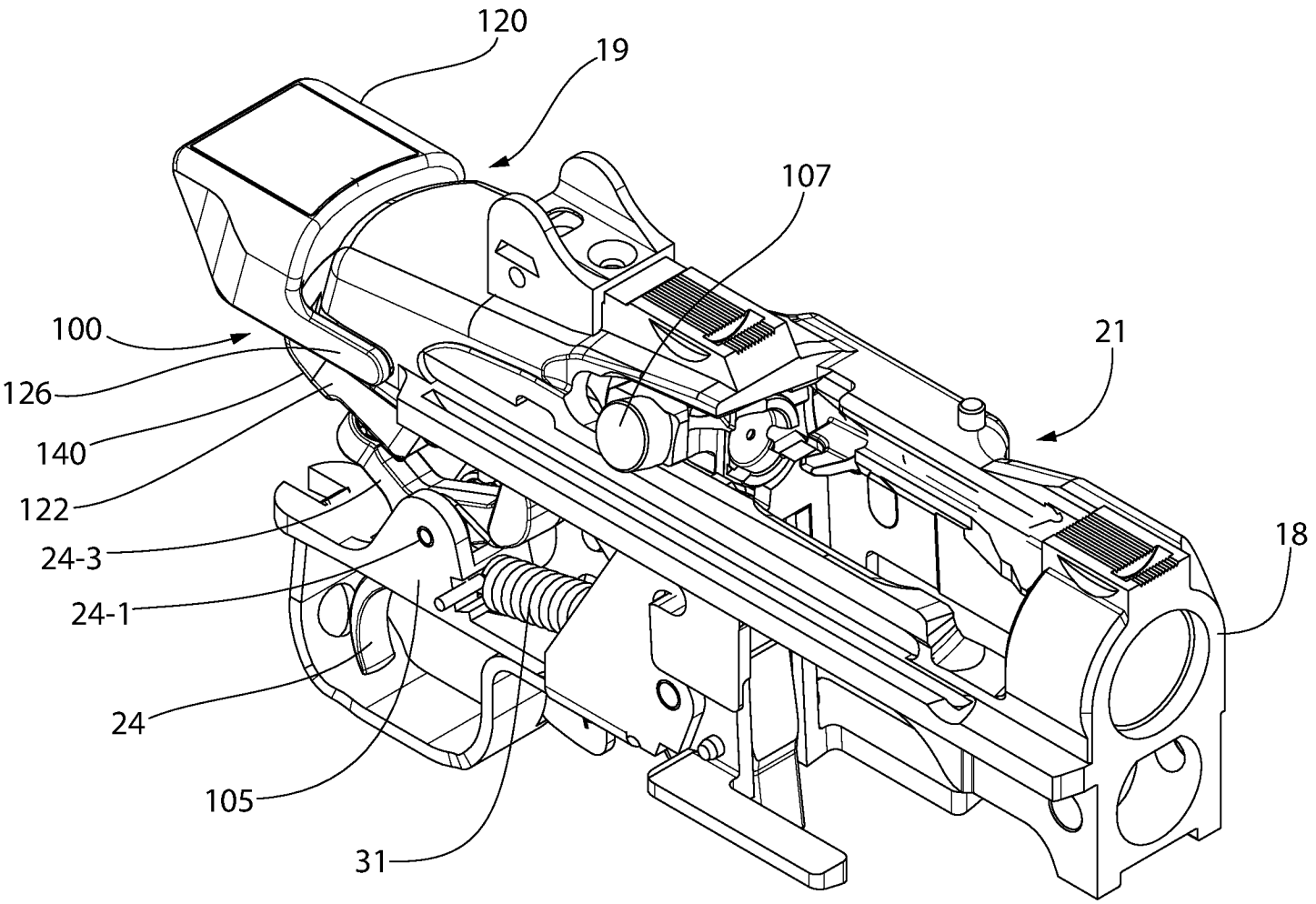
FIG. 14 is top front perspective view of the receiver, trigger group, and bolt release mechanism of the firearm of FIG. 1.
Figure 15:
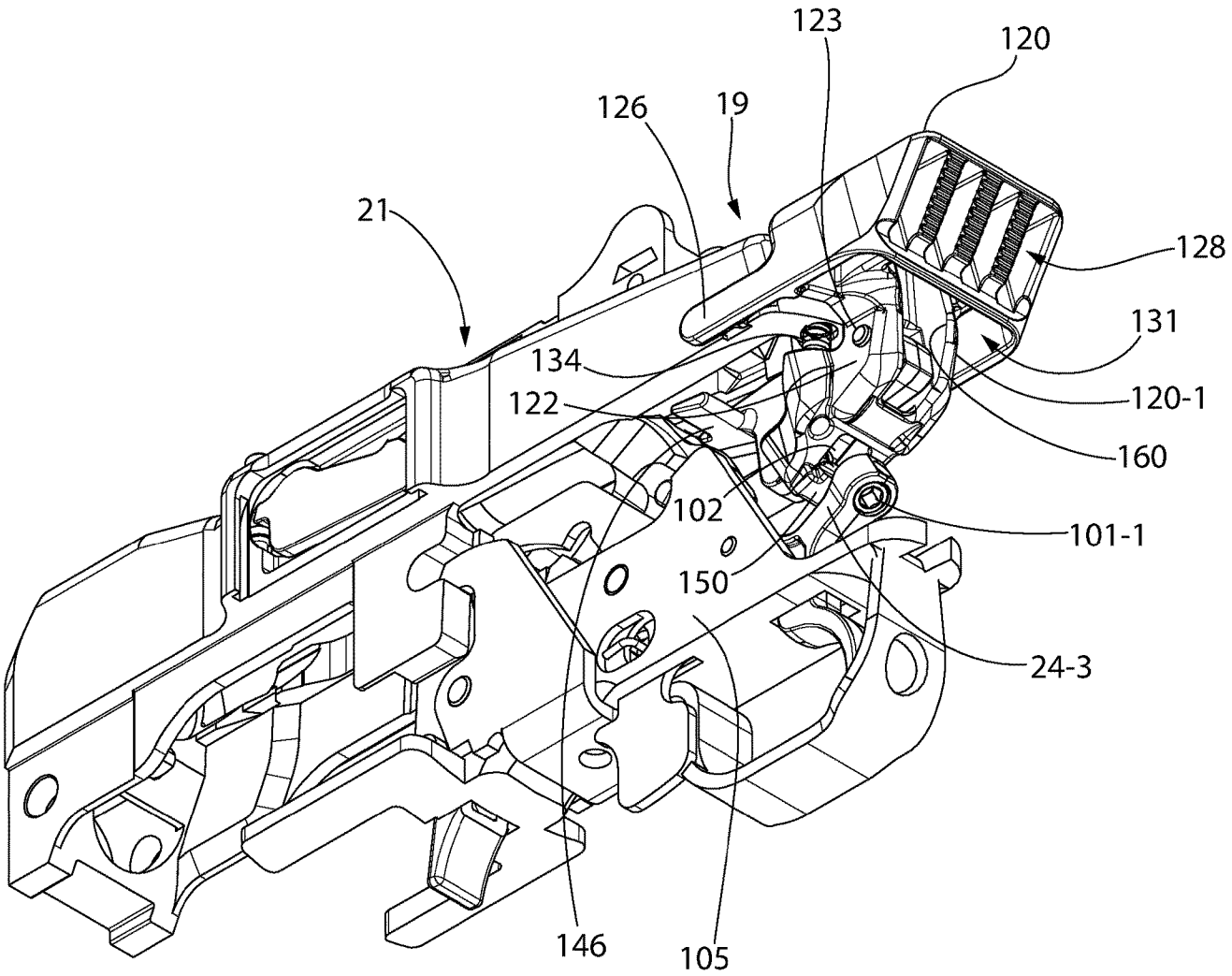
FIG. 15 is a bottom rear perspective view thereof.

The features and benefits of the invention are illustrated and described herein by reference to preferred but non-limiting exemplary ("example") embodiments. This description of the embodiments is intended to be read in connection with the accompanying drawings, which are to be considered part of the entire written description. Accordingly, the invention expressly should not be limited to such embodiments illustrating some possible non-limiting combination of features that may exist alone or in other combinations of features; the scope of the invention being defined by the claims appended hereto.

In the description of embodiments disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures may be secured or attached to one another either directly or indirectly through intervening structures, as well as both movable or rigid attachments or relationships, unless expressly described otherwise.

As used throughout, any ranges disclosed herein are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

FIGS. 1-34 depict a firearm 20 including a bolt release mechanism 100 according to the present disclosure. In one non-limiting embodiment, the firearm as illustrated may be a rifle. However, the firearm could be another type of long gun (e.g. shotgun, carbine, etc.) or other firearm. Accordingly, the invention is not limited in its applicability to rifles alone.

Firearm 20 includes a longitudinal axis LA, receiver 21, barrel 22 coupled thereto, an axially movable bolt 50, and a trigger-actuated firing mechanism 23 supported by the receiver and including a movable trigger 24 for firing the firearm. Bolt 50 cooperates with a manually retractable spring-biased slide 108 located laterally adjacent to and engaging the bolt (see, e.g. FIGS. 2, 4, 14, 16, 17, and 34). Slide 108 is longitudinally elongated and biases bolt 50 forward towards the closed breech position. Slide 108 includes a block shaped front portion 108-1 which is arranged beneath the barrel and a rearwardly extending and laterally offset rear portion 108-2. Bolt 50 includes a laterally/transversely projecting slide protrusion 107 received in a corresponding slide receptacle 109 (see, e.g. FIG. 34). In one embodiment best shown in FIG. 34, receptacle 109 may be an elongated slot including a front upwardly angled section 109-1 and a rear horizontal section 109-2. Bolt slide protrusion 107 travels in the slot between each section when the action is cycled. The slide 108 includes a laterally projecting slide handle 51 for manually cycling the bolt rearward.

The firearm includes an axially elongated chassis or stock 70 configured for holding by the user which supports the receiver 21 and barrel 22. A downwardly open magazine well 32 is formed by the receiver which holds a removable conventional ammunition magazine 33 (each shown in dashed lines) detachably mounted in the well. Such magazines may be a box-type magazine which holds a spring-biased vertical stack of ammunition cartridges C which are automatically uploaded into the breech area 34 for chambering into the barrel 22 by the bolt 50 when cycling the action. In one embodiment, the cartridge C may be a centerfire cartridge with a centrally located percussion cap disposed in the rear exposed end of the base of the cartridge. This type of cartridge is well known to those skilled in the art without further elaboration. Other embodiments may be chambered for conventional rimfire cartridges. The magazine 33 is removably retained in the magazine well 32 by a spring-biased magazine latch 35.

Barrel 22 includes an axial bore 37 extending longitudinally and axially from a rear breech end 38 to a front muzzle end 39 from which a bullet or slug is discharged from the firearm. The centerline of bore 37 is coaxial with and defines the longitudinal axis LA of the firearm. The rear breech end 38 of the barrel 22 defines a rearwardly open diametrically enlarged chamber 36 configured for holding a cartridge C.

Receiver 21 defines an axially elongated internal cavity 40 which slidably carries and supports the bolt assembly 50. Longitudinal cavity 40 extends along the longitudinal axis LA between an open front end 18 of the receiver in communication with the barrel chamber 36 for loading cartridges therein from the magazine 33 breech area via breech arear 34, and a closed rear end 19 defined by vertical rear end wall 43. Barrel 22 is coupled to the front end 18 of the receiver. In the illustrated embodiment, front end 18 defines a receptacle 18-1 configured to mate with the rear breech end 38 of barrel 22 (see, e.g. FIGS. 13 and 19). In one embodiment, barrel 22 may be threadably coupled to the receiver; however, other mounting arrangements may be used. In one non-limiting embodiment, the receiver 21 includes a right ejection port 44 and left ejection port 45 formed on opposite lateral sides 133 of the receiver.

The firing mechanism 23 further includes a pivotably cockable hammer 25. Hammer 25 is pivotably movable about a transverse pivot axis, defined by transversely oriented hammer pivot pin 25-1, between a rear angled or cocked position and an upright/vertical forward fire position via pulling the trigger 24. Hammer 25 is biased forward by hammer spring 31 towards the fire position. Referring to hammer 25 in the upright or vertical position for convenience of reference only, the hammer 25 may be considered to have a generally T-shaped body including an elongated mounting portion 25-4 having an enlarged bottom end 25-6 configured to receive pivot pin 25-1, and an opposite head comprising a front striking surface 25-5, rearwardly swept hammer catch 25-3, and a top actuating surface 25-2 extending therebetween. The front striking surface 25-5 may be substantially flat and arranged to strike the rear end of firing pin 30 slideably carried by the bolt 50 in a longitudinal firing pin bore 64. The front tip of firing pin 30 is arranged to strike a chambered cartridge C when the firing pin is driven forward by the hammer 25. Rear hammer catch 25-3 may be arcuately curved and configured with a catch or hook for holding the hammer 25 in the cocked position, as further described herein. The hook may be formed on the underside of catch 25-3 in one embodiment as shown. In one embodiment, the hammer body may be a monolithic unitary structure in which the mounting portion 25-4 and head with foregoing appurtenances are formed as integral parts thereof.

Trigger 24 is mounted for pivotable movement about a pivot axis defined by transverse trigger pivot pin 24-1 in one non-limiting embodiment. Pivot pin 24-1 may be mounted to trigger housing 105 in one non-limiting embodiment (see, e.g. FIG. The trigger 24 is configured and operable to operably interface and interact with the hammer 25 and bolt release mechanism as further describe herein. Trigger 24 has an elongated body comprising a downwardly extending curved finger grip portion 24-4, upwardly extending sear protrusion 24-2, and a cantilevered rearwardly extending blocking leg 24-3 comprising a trigger block protrusion 101 which forms the dual acting trigger interlock safety with the bolt release mechanism 100, as further described herein. The finger grip portion 24-4, blocking leg 24-3 and sear protrusion 24-2 may each elongated structures. Sear protrusion 24-2 may comprise a catch or hook configured and operable to selectively engage the hammer catch 25-3 for holding the hammer in the rearward cocked position, and to disengage the hammer catch for releasing the hammer to strike the firing pin 30 and discharge the firearm. The hook may be formed on the rear side of sear protrusion 24-2 in one embodiment as shown. In one embodiment, the trigger body may be a monolithic unitary structure in which the blocking leg, sear protrusion, and finger grip portion are formed as integral parts thereof. Accordingly, pulling finger grip portion 24-4 concomitantly rotates both blocking leg 24-3 and sear protrusion 24-2 in unison therewith.

With respect to the trigger interlock safety of the present invention, blocking leg 24-3 of trigger 24 may be arranged on the finger grip portion 24-1 of the trigger below pivot pin 24-1. The blocking leg may be a substantially linearly straight structure in one construction; however, non-linear configurations including curved structure may be used. Trigger block protrusion 101 in one embodiment may project perpendicularly and transversely upwards from blocking leg 24-3 to engage a downwardly open locking recess 102 of the bolt release mechanism 100 (see, e.g. FIGS. 25-33). In other possible arrangements, trigger block protrusion 101 may project obliquely with respect to blocking leg 24-3 of the trigger.

In one embodiment, the linear projection of trigger block protrusion 101 outwards from blocking leg 24-3 may be adjustable outward and inwards in the vertical direction. In such embodiments, the trigger block protrusion 101 may be formed by threaded cylindrical plug 101-1 threadably engaged with corresponding threaded through bore 104 formed proximate to rear end of the blocking leg 24-3. A spring-biased detent 103 engages the plug 101-1 to prevent the plug from loosening once adjusted to the desired projection distance by the user during operation of the firearm. In other embodiments, the trigger block protrusion 101 may alternatively be integrally formed with blocking leg 24-3 and non-adjustable. Operation of the trigger block protrusion 101 will be described in detail further below with discussion of the bolt release mechanism.

Trigger 24 is pivotably movable between an upright or vertical unpulled condition, and an angled pull condition. In the pulled condition with the finger grip portion 24-4 angled rearwards, the sear protrusion 24-2 is angled forwards and the blocking leg 24-3 is angled upwards to engage the bolt release mechanism 100. Trigger spring 24-5 biases the trigger towards the unpulled condition.

In one embodiment, the trigger 24 and hammer 25 may be mounted in a separate removable trigger housing 105 detachably coupled to the receiver 21. This facilitates assembly and maintenance of these firing mechanism components. Any means may be used to couple the trigger housing to the receiver, such as without limitation fasteners, interlocking tabs, or other fastening devices. Trigger guard 106 protects against inadvertent actuation of trigger 24 and firing of the firearm. It bears noting that the bolt release mechanism (i.e. release button 120 and disconnect lever 140) may be mounted separately to the receiver 21 due to the unique and convenient in-line placement of the mechanism with the receiver in the present invention, which advantageously maintains a compact firearm both functionally and aesthetically.

Bolt 50 has an elongated generally cylindrical body comprising a front end 41, rear end 42, and opposing top and bottom surfaces 50-4, 50-5 extending between the ends. Front end 41 defines a vertically oriented forward facing breech surface or face 50-1 for forming a closed breech. Firing pin 30 is slideably disposed in the cylindrical axial firing pin bore 64 of the bolt body which extends between the front and rear ends 41, 42 of the bolt 50. Bore 64 has a rear opening which opens through rear end 42 of bolt 50 and a front opening which opens through the front end 41 of the bolt. The rear end of the firing pin 30 protrudes beyond the rear end 41 of the bolt from the firing pin bore 62 for contact by the released hammer 25 when the trigger 24 is pulled to discharge the firearm. The front end of the firing pin is selectively projected forward from front end 42 of bolt 50 when the hammer strikes the rear end of firing pin to contact and detonate a chamber cartridge. Bolt 50 further includes an angled or rounded cam 110 arranged to engage the disconnect lever of the bolt release mechanism 100, as further described herein. In one construction, the cam 110 may be formed at the bottom of the rear end 41 of the bolt at the bottom corner (see, e.g. FIG. 27).

Bolt 50 is slideably and axially movable along longitudinal axis LA in the internal longitudinal cavity 40 of the receiver 21 between forward closed breech and rearward open breech positions. Bolt 50 is also automatically moved under recoil forces produced by discharging the firearm via a trigger pull from the forward to rearward position. Longitudinal cavity 40 therefore has an axial length sufficient to provide the full range of motion necessary for the bolt 50 under recoil to open the breech sufficiently for extracting a spent cartridge casing from barrel chamber 36, ejecting the spent cartridge casing, and uploading a fresh new cartridge from the magazine 33 into the breach area for chambering by the bolt during its forward return motion. Slide spring 163 biases slide 108 (described above) operably engaged with and cooperating with the bolt 50 to bias and return the bolt forward to the closed breech position in a conventional manner after the bolt release mechanism is actuated. The slide comprises slide handle 51 to manually retract the bolt and open the breech and buffer rod 164 which mounts and guides the spring 163 in a rearwardly open socket 108-3 formed in the front portion 108-1 of slide 108 (see, e.g. FIG. 34). Spring 163 may be a coil compression spring; however, other type springs may be used in other embodiments.

In some preferred but non-limiting embodiments, longitudinal cavity 40 of the receiver may include an angled and downward sloped from front to rear in a rear section 40-1 of the cavity. This properly positions the bolt 50 for engagement with the disconnect lever of the present bolt release mechanism, as further described below. Cavity 40 thus defines a rear cavity centerline CL1 which is obliquely angled to longitudinal axis LA of the firearm (see, e.g. FIG. 25). When the bolt 50 reaches its rearward axial position inside the cavity, the bolt axis BA is concomitantly obliquely angled to longitudinal axis LA. The front section 40-1 of the cavity 40, however, has a front cavity centerline CL2 which is parallel to the longitudinal axis LA. This ensures that the bolt 50 and particularly the front breech face 50-1 of bolt 50 is square with the rear breech end of the barrel to properly support the base of the cartridge and pressure seal the chamber 36.

The bolt release mechanism 100 components and operation will now be described in greater detail. Referring generally to FIGS. 1-33, the bolt release mechanism includes disconnect lever 140 and an actuator which may be in the form of the pivotably slideable release button 120 operably interacting and cooperating with the lever for releasing the bolt forward back into battery with the barrel after each shot. Disconnect lever 140 is pivotably coupled to release button 120 via transverse pivot pin 123. The ends of pin 123 may terminate at the right and left lateral sides 161 of the release button (right and left based on view forward by the user at the rear of the firearm) and therefore do not engage the receiver 21 or stock 70 in the illustrated embodiment. Accordingly, pivot pin 123 does not form a pivot axis for the release button, but rather only for the disconnect lever 140.

In one embodiment, release button 120 may have a generally L-shaped body including an exposed rear actuating portion 121, and forward coupling portion 122 for mounting disconnect lever 140 thereto via transverse pivot pin 123. Coupling portion 122 extends forwardly from actuating portion 121 inside stock 70 below the rear end of the receiver 21. By contrast, actuating portion 121 is inline with the rear end 19 of receiver 21 and slideably engages the rear end, as further described herein.

Release button 120 is vertically movable via actuating portion 121 between a downward unactuated position and upward actuated position for releasing the bolt forward from its rear position engaged by the hammer 25 to reclose the breech.

Actuating portion 121 has a block-like structure including a rear downwardly angled and forward sloping rear wall 128 (top to bottom) defining an actuating surface 128-1 arranged and configured for engagement by user's thumb or finger to actuate the bolt release mechanism, a front wall 129, a top wall 130, bottom 131, and opposing lateral sides 161 extending between the front and rear walls. Top wall 130 projects rearward farther than an overhangs bottom wall 131. Actuating portion 121 is positioned adjacent and mounted to the rear end 19 of the receiver 21 via a pair of laterally spaced mounting arms 126. Arms 126 extend in a forward direction from the release button and selectively engage laterally open longitudinal slots 127 formed in each lateral side 133 of the rear end 19 of the receiver (see, e.g. FIG. 16). In one embodiment, the terminal front ends of mounting arms 126 may each comprise an inwardly projecting pivot protuberance 132 to better engage slots 127. The forward end of slots 127 may include outwardly open cylindrical mounting receptacles 127-1 to better engage the pivot protuberances 132 of the release button arms 126 (best shown in FIGS. 14-17). Pivot protuberances define a pivot axis P3 of the release button 120 and concomitantly the bolt release mechanism 100.

When release button 120 is in the downward unactuated position, the mounting arms 126 of actuating portion 121 are fully engaged with longitudinal slots and oriented substantially parallel to longitudinal axis LA of firearm 20. When release button 120 is in the upward actuated position, mounting arms 126 leave the slots except for the retention protuberances 132 thereby maintaining engagement with the slots. In this position, arms 126 are obliquely oriented to longitudinal axis LA. The actuating portion 121 of the release button essentially pivots about the protuberances as release button 120 moves between the unactuated and actuated positions.

Figure 23:
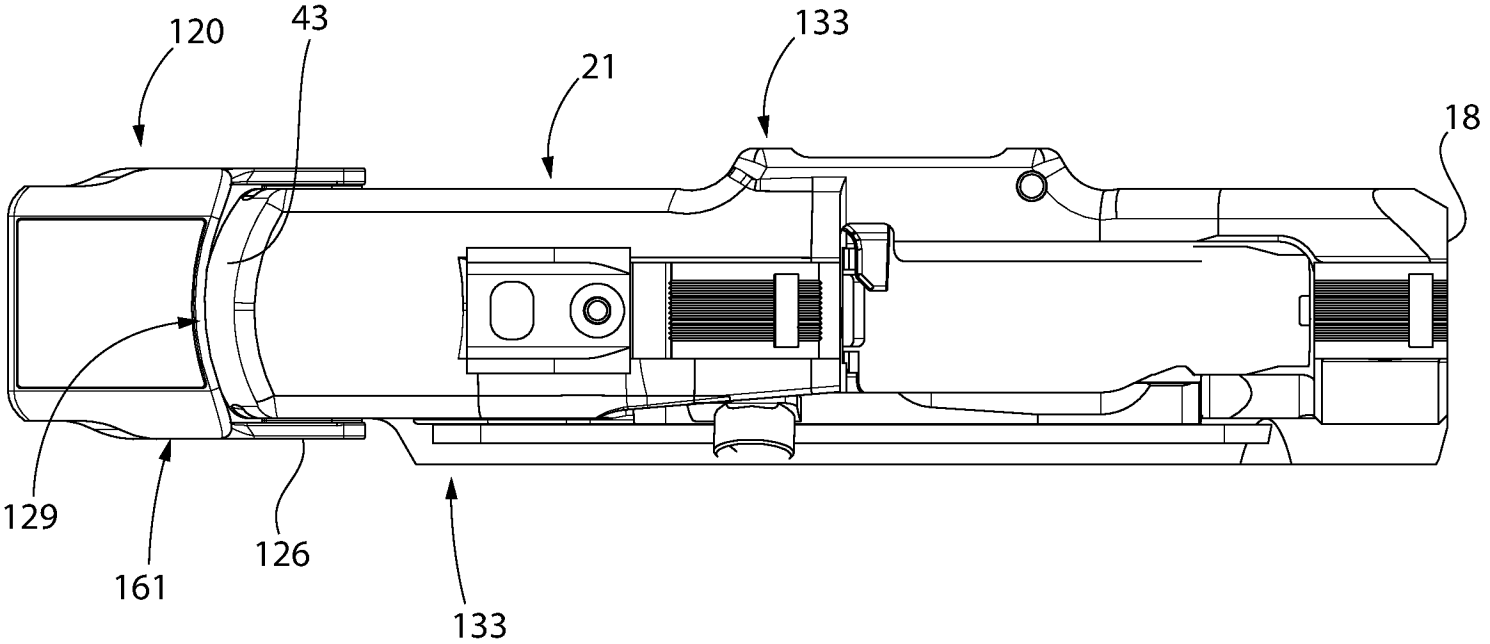
FIG. 23 is a top view thereof.
Figure 24:
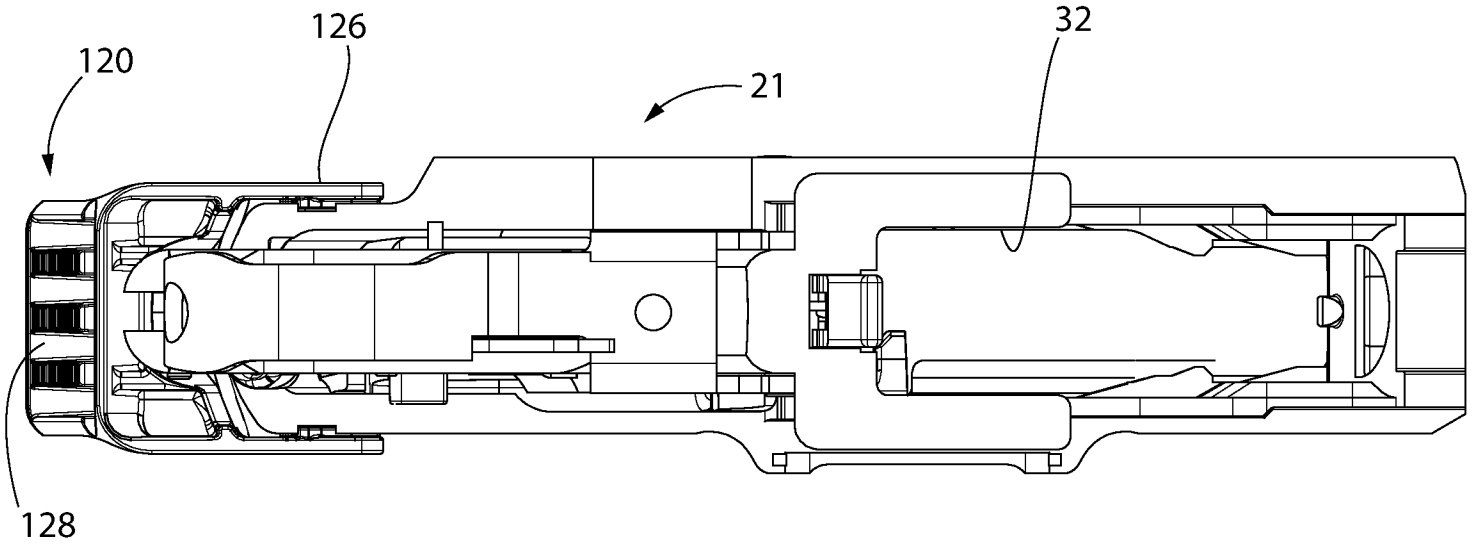
FIG. 24 is a bottom view thereof.

To provide a compact bolt release mechanism which is accessible to the user without their trigger hand substantially leaving the firearm, the actuating portion 121 of release button 120 is preferably axially aligned with the longitudinal axis LA of the firearm adjacent to the rear end 19 of receiver 121 as shown. Actuating portion 121 of the release button extends rearward from the rear end wall 43 of the receiver. As best shown in FIG. 23, the right and left lateral sides 161 of release button actuating portion 121 preferably do not project laterally outwards beyond the laterally widest parts of the receiver defines by the right and left lateral sides 133 of the receiver 21 (side designations from shooter's vantage looking forward while holding the firearm). This advantageously maintains the compact design of the bolt release mechanism and avoids interference with carrying and storage of the firearm. Moreover, the user can maintain their hand easily in substantial axial alignment with the firearm without an undue lateral or twisting motion to actuate the bolt release. This results in a more natural hand action. In total, the present design thus facilitates rapid firing of the firearm even with an interrupted action firing system.

Figure 16:
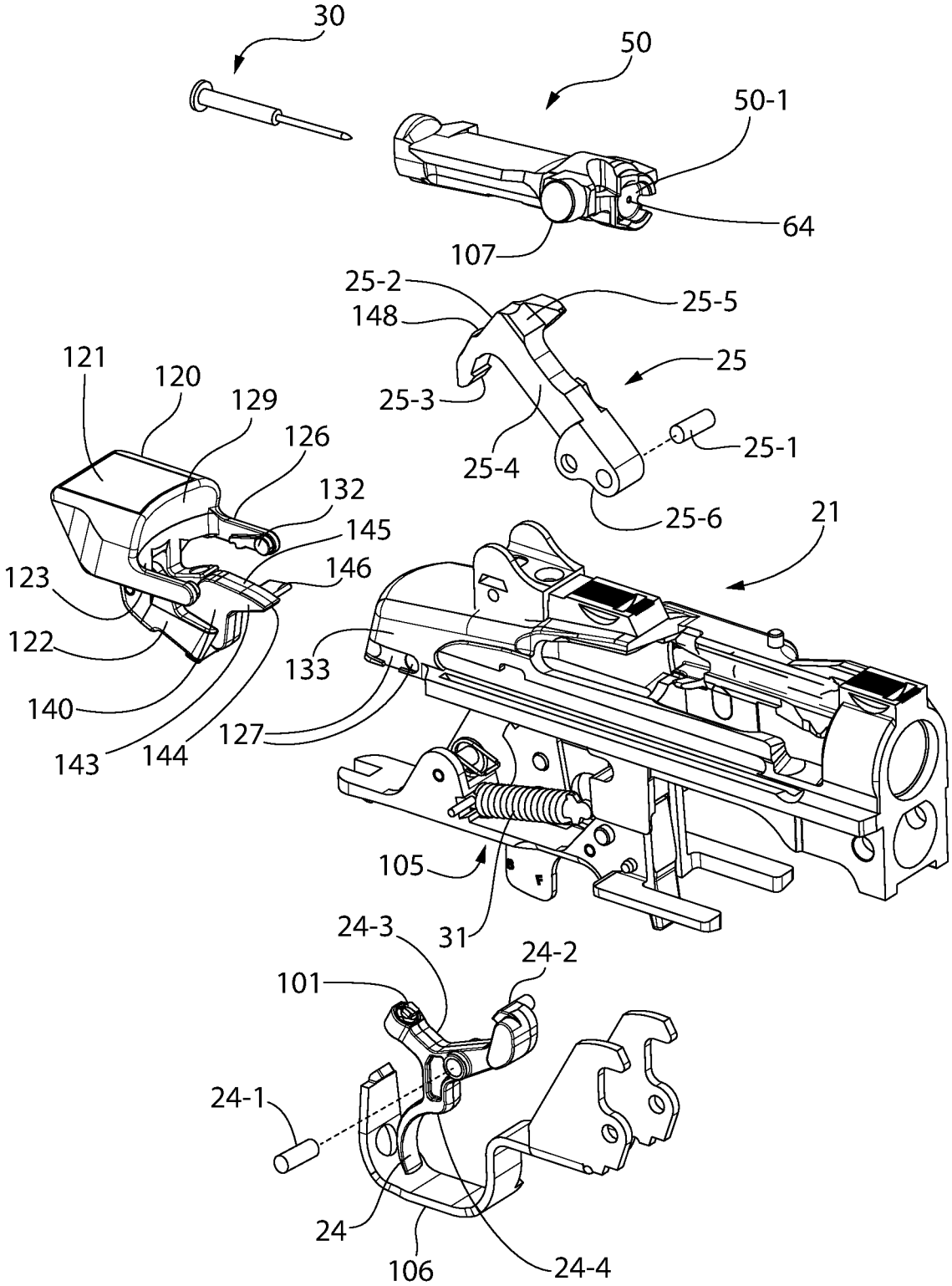
FIG. 16 is a top front exploded perspective view thereof.
Figure 17:
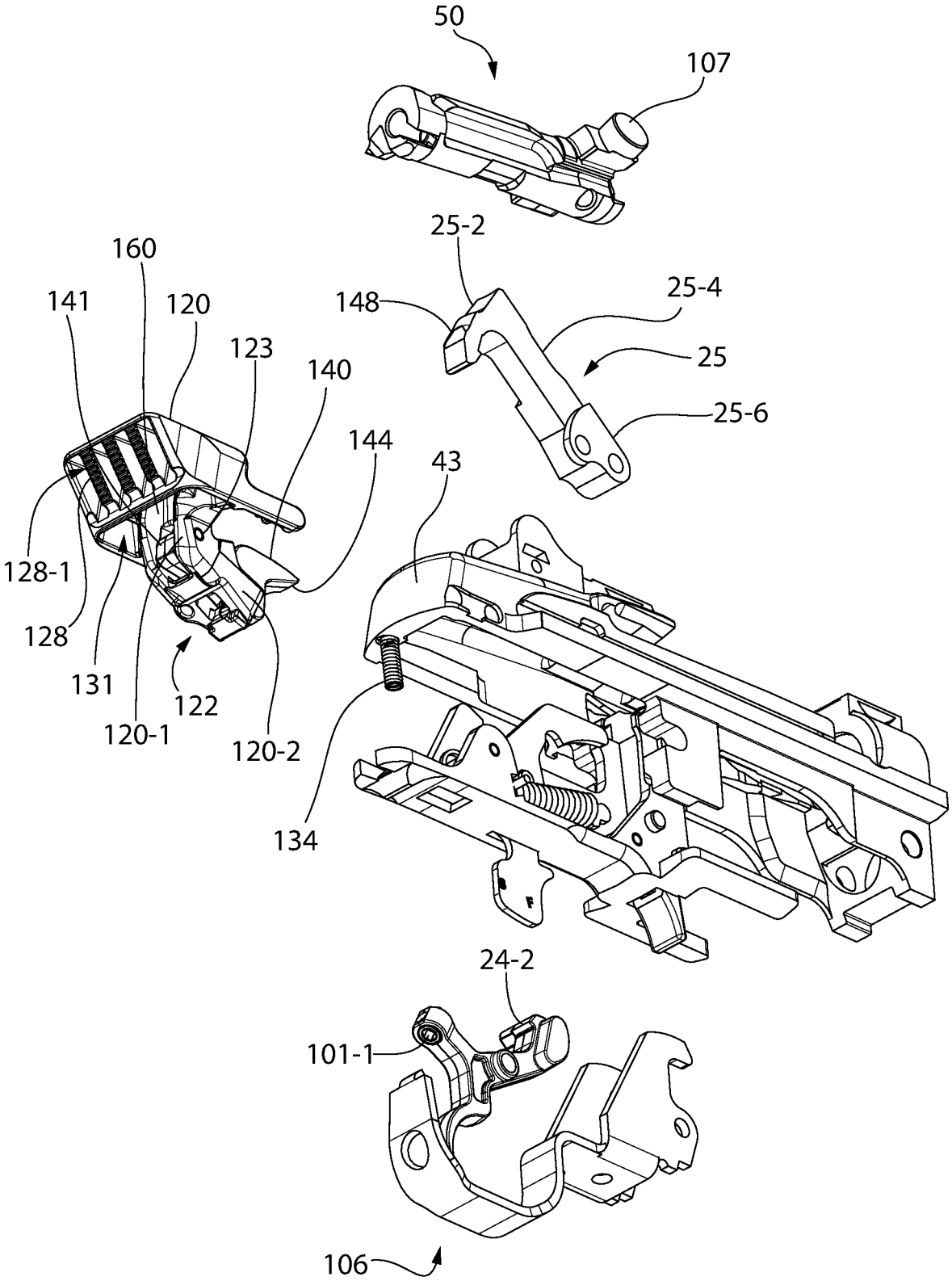
FIG. 17 is a bottom rear exploded perspective view thereof.
Figure 18:
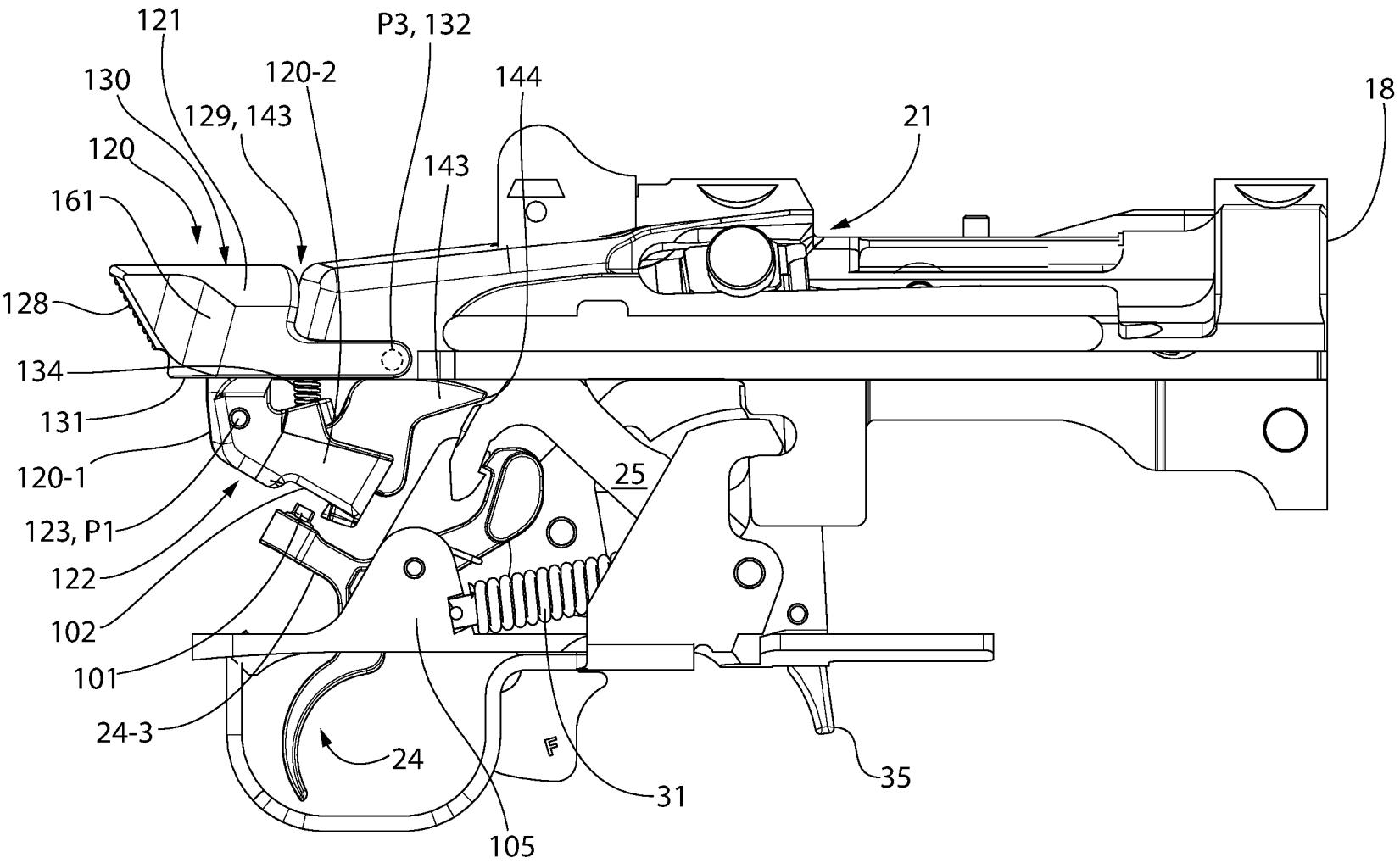
FIG. 18 is a right side view thereof.
Figure 19:
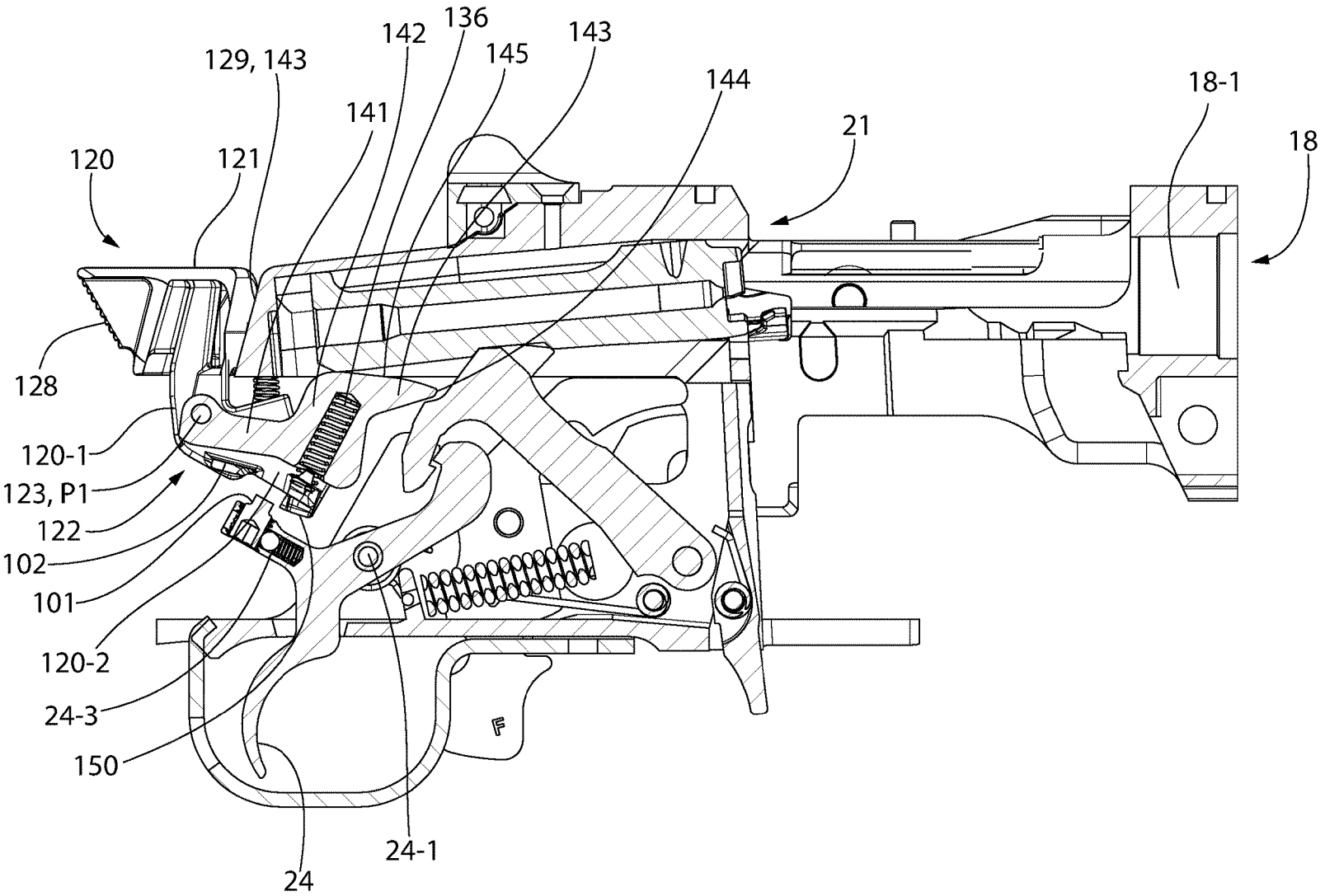
FIG. 19 is a cross-sectional view thereof.
Figure 20:
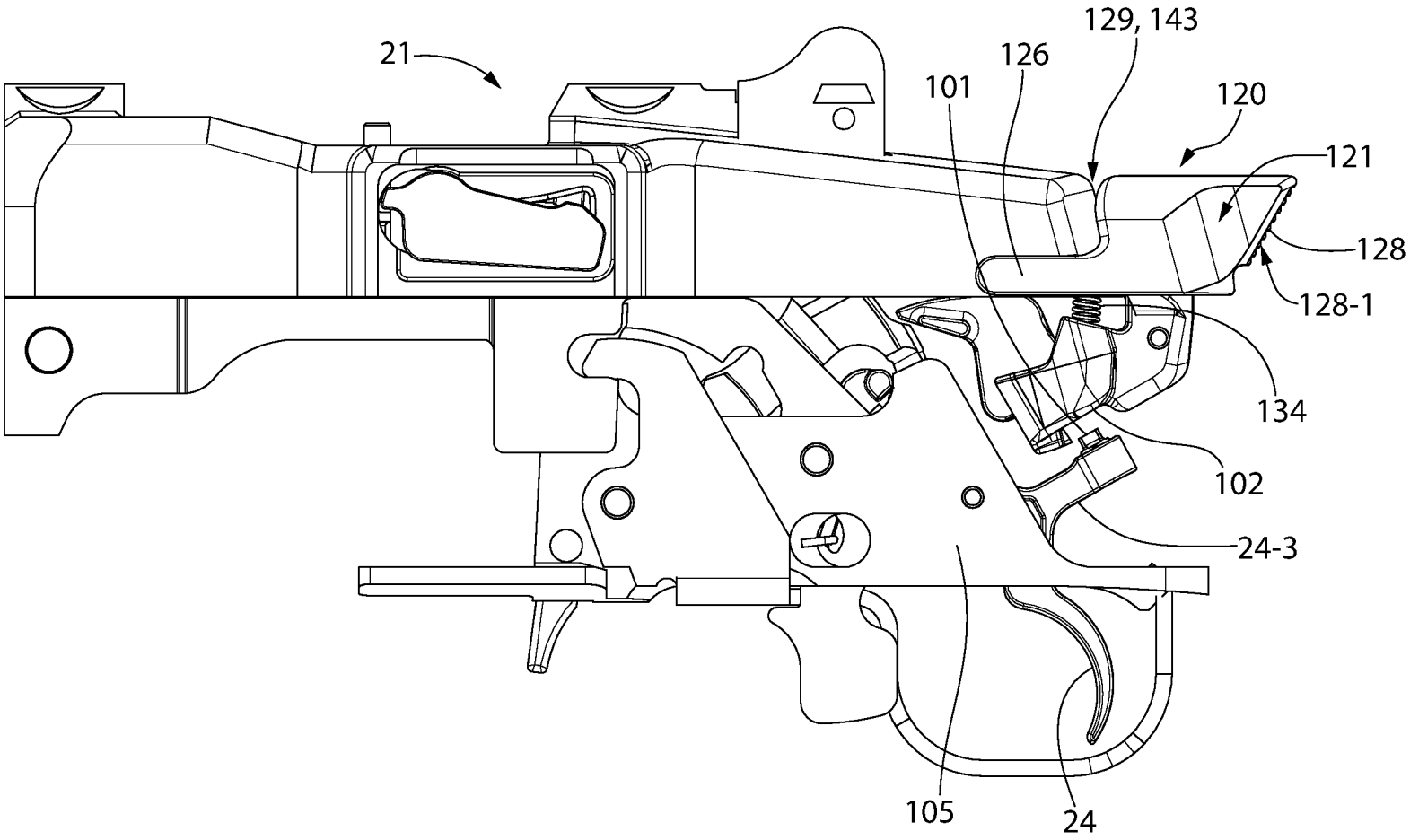
FIG. 20 is a left side view thereof.
Figure 21:
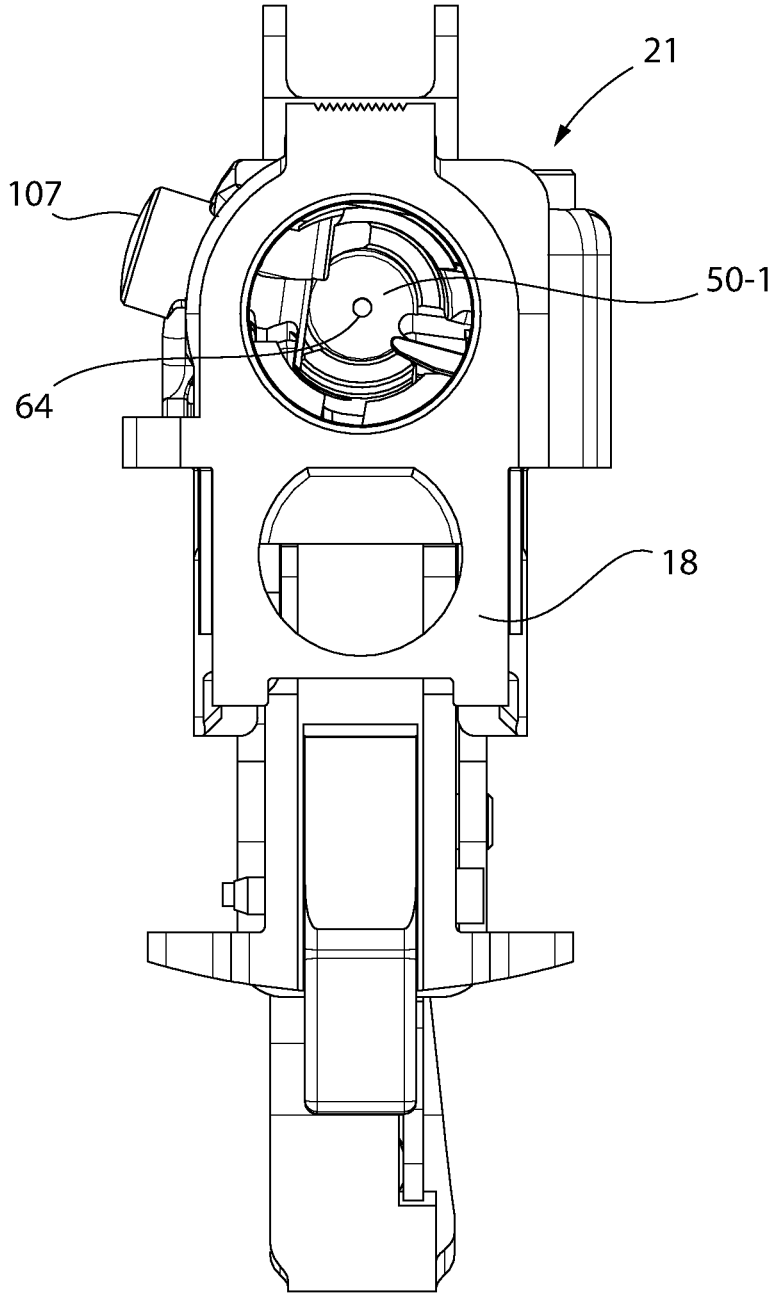
FIG. 21 is front view thereof.
Figure 22:
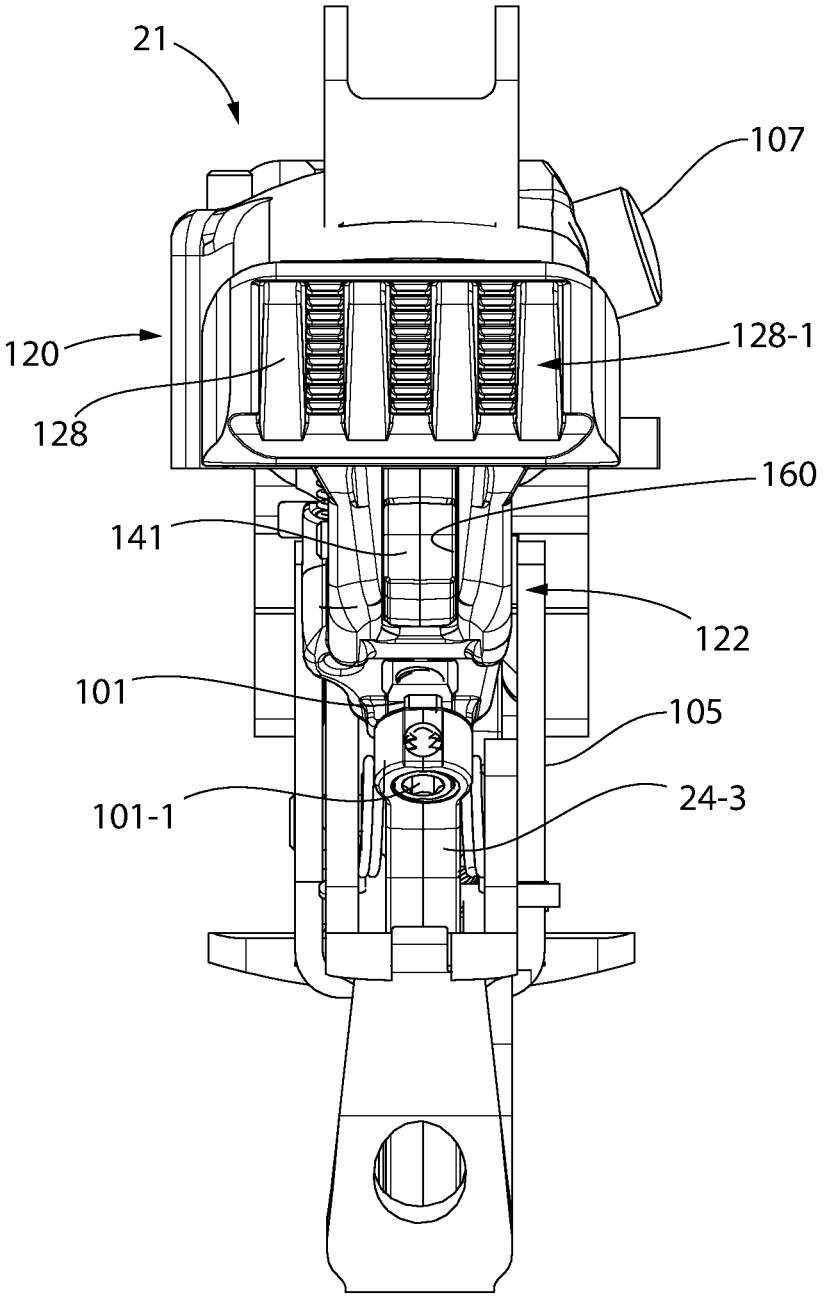
FIG. 22 is a rear view thereof.

In one embodiment, referring particularly to FIGS. 16, 17, and 19, the receiver rear end wall 43 may be angled obliquely to the longitudinal axis LA sloping downwardly and rearwardly, and front wall 129 of the release button actuating portion 121 has a complementary angle. This creates an angled but slideable operating interface and abutment therebetween. In one embodiment, receiver rear end wall 43 and release button front wall 129 may be arcuately curved from side to side (best shown in FIG. 23). When release button 120 is actuated, the front wall 129 of actuating portion 121 slideably engages and rides upwards along the rear end wall 43 of receiver 21. The end wall 43 thus advantageously provides guided and supported motion of the actuating portion which creates smooth operation of the release button.

The coupling portion 122 of release button 120 comprises a rear vertical section 120-1 and a generally downwardly angled front section 120-2. Disconnect lever 140 may be pinned to the rear section in one embodiment. A reset spring 134 arranged and acting between the underside of the receiver 21 and the front section 120-2 serves to automatically return the release button 120 from the upward actuated position to the downward unactuated position when the button is released. Spring 134 may be a coil compression spring in one embodiment; however, other type springs may be used. Coupling portion 122 further defines a longitudinally-extending channel 160 between its right and left sidewalls 135 which receives rear mounting leg 141 of disconnect lever 140 therein for connection to pivot pin 123.

The rear wall 128 of the release button actuating portion 121 defines an actuation surface 128-1 may be textured in some embodiments to facilitate engagement with the user's thumb for actuating the bolt release. This proves helpful especially in wet and/or cold firing conditions.

Bolt release mechanism 100 further includes an operating spring 136 arranged and acting between the release button coupling portion 122 and disconnect lever 140. Spring 136 may be a coil compression spring in one embodiment; however, other type springs may be used. Disconnect lever 140 includes a downwardly open bore 137 which receives spring 136. The top end of spring 136 acts inside the bore on the lever 140 and bottom end of the spring acts on the front end of front section 120-2 of the coupling portion 122 of the release button 140. This biases the lever upwards to its upward position, and concomitantly biases the coupling portion 122 of release button 120 and disconnect lever 140 apart in a spring-loaded scissor type action. Disconnect lever 140 may include a laterally projecting travel stop 146 which abuttingly engages against a bottom surface of the receiver 121 to limit the upward position of the disconnect lever. In the upward position, the uppermost portion of the disconnect lever projects at least partially into the longitudinal cavity 40 (i.e. rear section 40-1) to engage the bolt 50, as further described herein.

The disconnect lever 140 will now be described in greater detail. Lever 140 may have a generally S-shaped body comprising a vertically elongated upright central portion 142, elongated rear mounting leg 141 extending rearwardly from the central portion, and a front working protrusion 143 extending forwardly from the central portion. Spring bore 137 may be formed in the central portion in one embodiment. The rear terminal end of rear mounting leg 141 is pinned to coupling portion 122 of release button 120. The front working protrusion 143 may be generally wedge-shaped in one embodiment and terminates in a narrowed front contact tip 144 arranged to selectively engage the top surface of the hammer 25, as further described herein. Tip 144 may preferably be slightly rounded for smooth engagement with the hammer. The top of disconnect lever 140 defines an upward facing cam surface 145 extending along the entire central portion to the front contact tip 144. The upward facing cam surface 145 is arranged to be engaged by the cam 110 of the bolt 50 when in its axial rearward position. In one embodiment, the cam surface may be slightly arcuately curved to facilitate smooth engagement with the cam 110 of bolt 50.

The release button 120 and disconnect lever 140 may each be monolithic unitary structures which include their respective constituent parts previously described herein. The release button and disconnect lever may be formed of a metallic or non-metallic material. In one non-limiting embodiment, release button 129 may be formed of a suitable polymer such as nylon reinforced plastic and disconnect lever 140 may be formed of metal such as steel or aluminum as some non-limiting examples.

The bolt release mechanism 100 has a unique operational feature which relies on interaction of bolt 50 with the mechanism. As previously described herein, the disconnect lever 140 has a rear "mounted" pivot axis or point P1 where its rear end is pinned to the release button 120 via transverse pivot pin 123. This physical connection thus forms a fixed or permanent primary rear pivot axis or point of the disconnect lever. The disconnect lever 140 however further has a secondary transient forward pivot axis or point P2 (not associated with the rear pinned connection) whose formation depends on whether the bolt is in the forward or rearward position. As previously described herein, operating spring 136 acting between the release button 120 and disconnect lever 140 biases the lever upwards into its upward position (limited only by travel stop 146). When the bolt is in battery (i.e. forward closed breech position), there is no element of the firearm in contact with the top cam surface 145 of the disconnect lever 140 which remains in its upward position. Accordingly, movement of release button 120 from its downward unactuated position to its upper actuated position does not appreciably move the front contact tip 144 of the disconnect lever 140 either upward or downwards because there is no physical element against which the cam surface 145 may be braced to rotate front contact tip 144 of disconnect lever 140 downwards to counter the foregoing upward biasing action of operating spring 136.

Conversely, when the bolt 50 is locked in its rearward open breech position to the rear of receiver 21, the cam 110 formed on the bottom of the bolt engages top cam surface 145 of disconnect lever 140 thereby forming a fulcrum at the contact point which defines a secondary transient forward pivot axis or point P2 which exists only as long as bolt 50 remains in its rearward position. With release button 120 still in its downward unactuated position, bolt cam 110 now pushes the disconnect lever 140 downwards contacting its front contact tip 144 against the top actuating surface 25-2 of hammer 125 which is holding the bolt 50 in its rearward axial position. The contact is not sufficient to displace the hammer 25 downwards and disengage it from bolt 50 while release button 120 remains in the unactuated position. In this downward position of the disconnect lever 140, upwards movement of release button 120 to its actuated position now rotates the front contact tip 144 of the lever working protrusion 143 farther downwards (clockwise in FIG. 29) about the fulcrum formed at the cam-cam surface interface (transient forward pivot axis/point P2) against the upward biasing action of operating spring 136. This additional movement of the disconnect lever front contact tip 144 is sufficient to force the hammer farther downwards/rearwards removing catch protrusion 148 of the hammer out of retention notch 147 on the bottom of the bolt 50. The bolt 50 is released and returns forward under the biasing action of the slide spring 163 associated with slide 108 to its forward closed breech position back in battery with the barrel. The transient forward pivot axis/point P2 no longer exists.

The foregoing unique aspects of the present bolt release mechanism will become further apparent upon describing the operation of the mechanism below.

A method for operating a firearm with the interrupted action according to the present disclosure will now be described with reference to FIGS. 25-33. These figures depict sequential views in the operation of the action. General reference is made however to FIGS. 1-24 as applicable.

Figure 25:
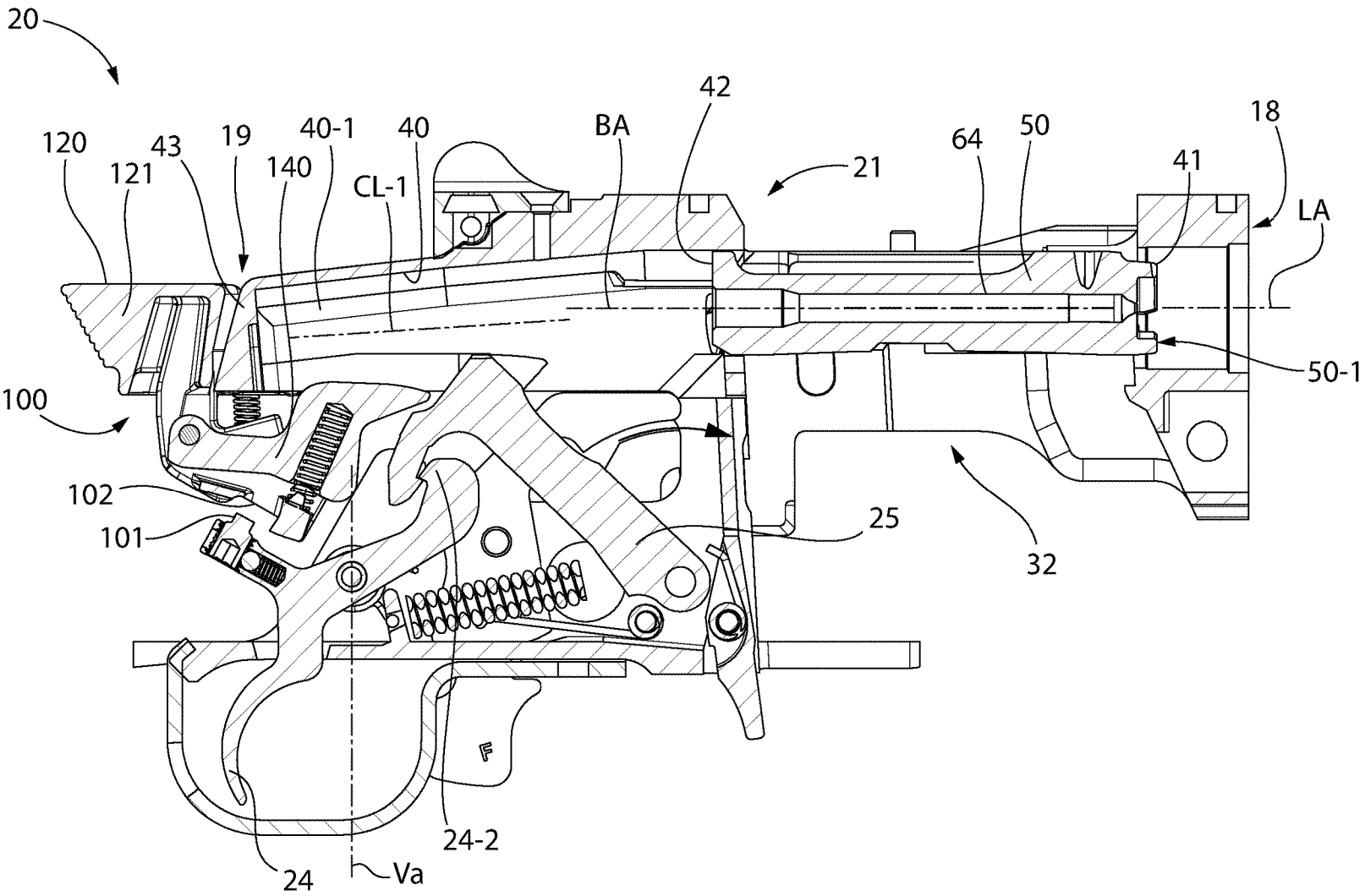
FIG. 25 is a first right side cross-sectional view of a sequential series of figures showing the same view as it progresses during operation of the interrupted action of the firearm of FIG. 1.

FIG. 25 shows the provided firearm 20 with bolt release mechanism 100 each in the ready-to-fire position. Trigger 24 is in its forward unpulled condition albeit with finger grip portion 24-4 obliquely angled to vertical trigger axis Va of the trigger defined as extending through trigger pivot pin 24-1. In other possible constructions, grip portion 24-4 may be parallel to trigger axis Va. Bolt release mechanism 100 is unactuated. Bolt 50 is in its forward closed breech position in battery with barrel 22 at its rear breech end 38 adjacent chamber 36 which contains a cartridge C (not shown in this particular figure). In addition, bolt 50 is positioned in the front section 40-2 of the receiver cavity 40 and parallel to longitudinal axis LA. Hammer 25 is held in the cocked rearward position (obliquely angled to vertical trigger axis Va) by sear protrusion 24-2. Disconnect lever 140 is in its upward position with forward working protrusion 143 substantially horizontal such that top cam surface 145 of the lever is positioned in rear section 40-1 of receiver longitudinal cavity 40.

As further seen in FIG. 25, the trigger interlock safety is in the deactivated state. Accordingly, trigger block protrusion 101 on blocking leg 24-3 of the trigger 24 is retracted from locking recess 102 of the release button 120, thereby allowing the trigger to be pulled without interference from the interlock created with the bolt release mechanism so long as the bolt release mechanism remains unactuated.

Figure 26:
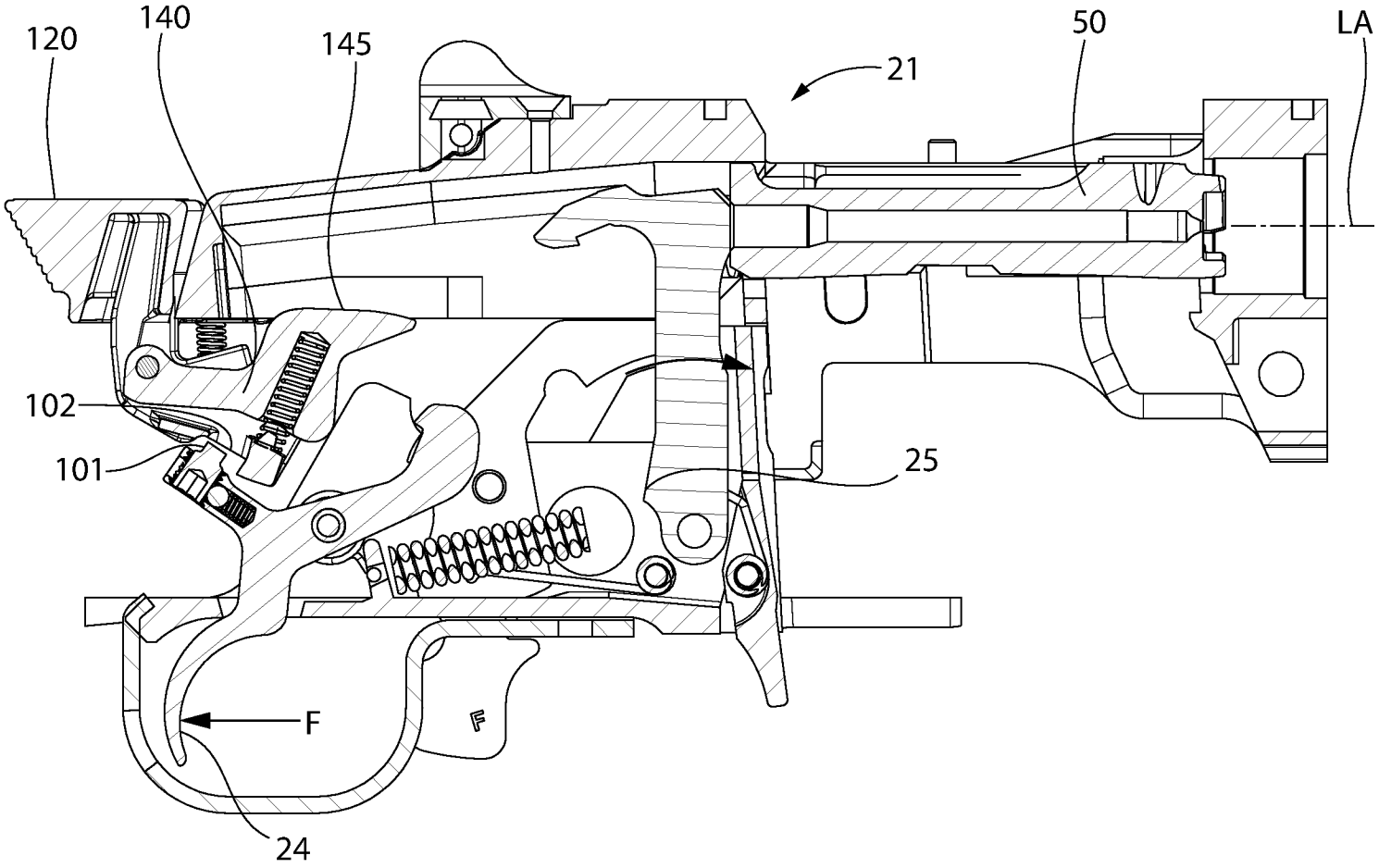
FIG. 26 is a second sequential view thereof.

Next, FIG. 26 shows firearm immediately after the trigger 24 has been pulled rearward (force F) to release the hammer 25 from the trigger sear protrusion 24-2 and discharge the firearm. Hammer 25 rotates to its upright forward fire position (substantially parallel to vertical trigger axis Va) striking the firing pin 30, which in turn drives the firing pin forward to strike the percussion cap in the rear base of the cartridge. This detonates the round which launches the projectile down the barrel bore 37. Note that the cam surface 145 of disconnect lever 140 remains in the upright position partially entering the rear section 40-1 of receiver longitudinal cavity 40 for eventual contact by the bolt cam 110 during its rearward motion, as further described during the firing sequence below.

Notably in FIG. 26, the trigger interlock safety has been activated such that trigger block protrusion 101 has moved upwards via the trigger pull to now engage locking recess 102 of the disconnect lever 140 as the rear blocking leg 24-3 of the trigger rotates upwards with the rearward pull of the trigger. When the interlock safety has been activated, the release button 120 of bolt release mechanism 100 cannot be actuated (i.e. moved upwards). This prevents the firearm from automatically firing unintentionally if the bolt were released while the trigger was still pulled. The safety remains activated until the user releases the trigger.

Figure 27:
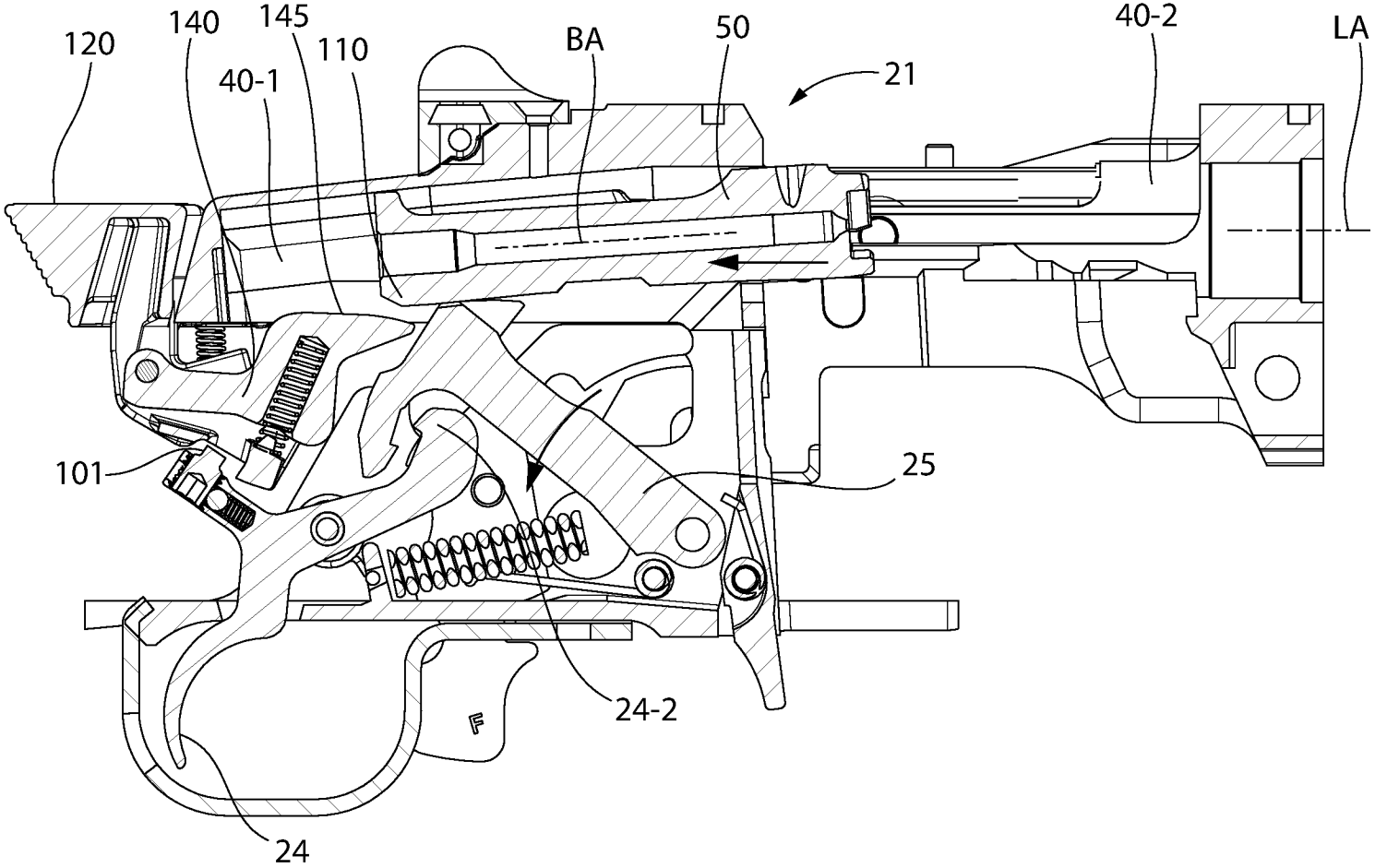
FIG. 27 is a third sequential view thereof.

FIG. 27 shows firearm 20 after being fired causing the action to begin to cycle. Here, bolt 50 has started moving axially rearward to the point which opens the breech as the combustion gases traveling forward from the fired cartridge creates an opposite rearward recoil thrust against the breech face of the bolt. The rear end 41 of bolt 50 has entered the downward sloping rear section 40-1 of receiver cavity 40, which causes the bolt to assume a tilted position obliquely angled to longitudinal axis LA (note bolt axis BA in comparison). The bolt has also has moved far enough back to engage and rotate the hammer 25 back rearward and just past the front contact tip 144 of disconnect lever 140. Rotation of the hammer breaks engagement with the sear protrusion 24-2 of trigger 24 as shown. Hammer 25 is now momentarily held in its rearward position via engagement by the bolt.

Figure 28:
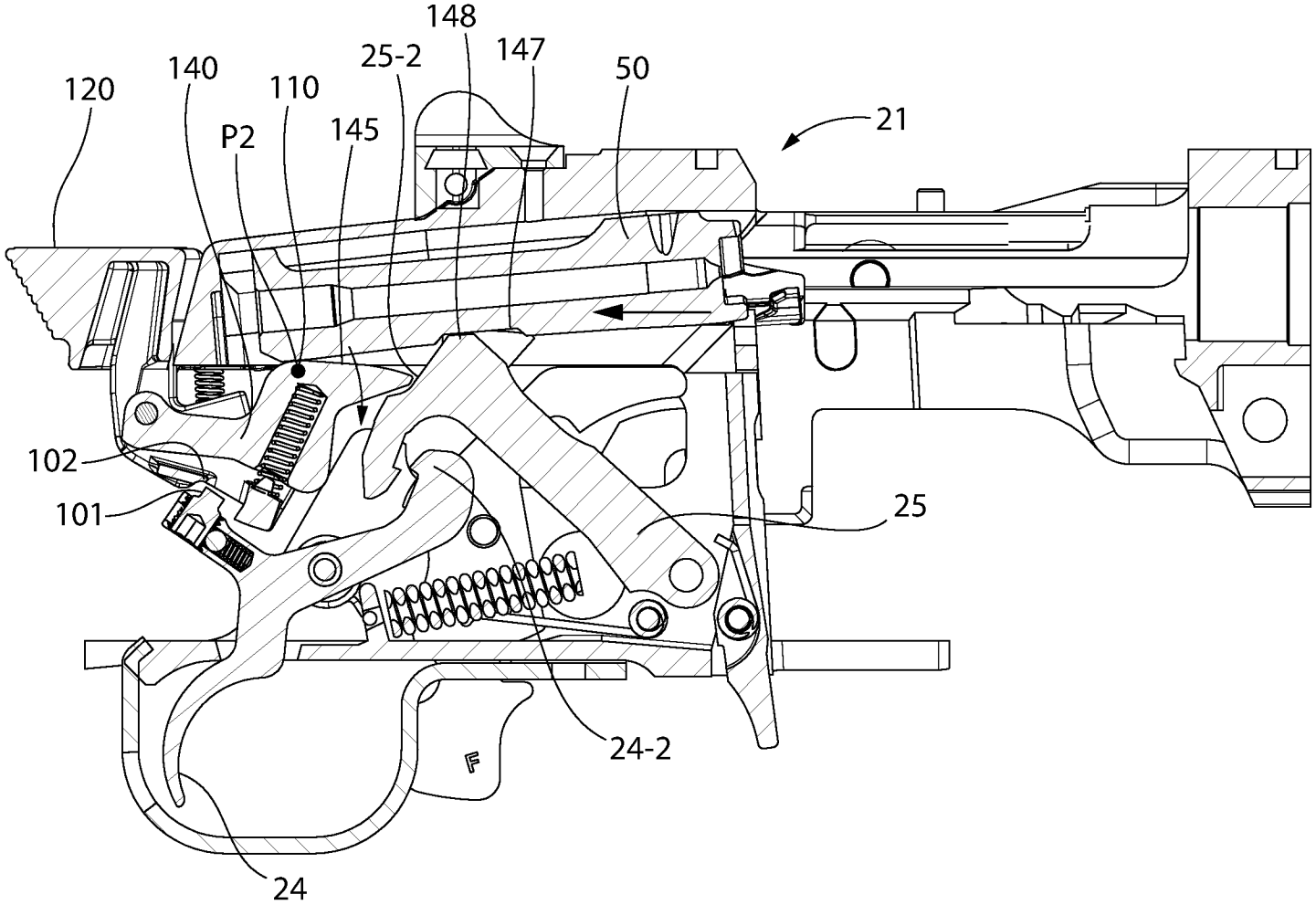
FIG. 28 is a fourth sequential view thereof.

FIG. 28 shows the bolt 50 traveling farther rearward into rear section 40-1 of receiver cavity 40 as it bottom surface slideably continues to hold hammer 25 downwards. Bolt 50 has finished traveling rearward and is now in its rearward-most position. Cam 110 defined on the underside of bolt 50 now engages cam surface 145 on disconnect lever 140 of the bolt release mechanism 100 and pushes/displaces the disconnect lever 40 downwards, thereby partially rotating the front contact tip 144 of the lever into contact with the top actuating surface 25-2 of the hammer 25. Importantly, for purposes of forming the present interrupted action, the catch protrusion 148 of the hammer 25 has engaged retention notch 147 on the bottom of the bolt 50 thereby arresting its forward travel under the biasing action of the recoil spring. Bolt 50 may be simultaneously engaged with both disconnect lever 140 and hammer 25 as shown. It bears noting that the foregoing displacement of disconnect lever 140 by the bolt is not sufficient however to displace the hammer sufficiently to break contact between the hammer and bolt, but merely takes up slack in the linkage by closing the gap between the disconnect lever and hammer in preparation for releasing the bolt. This advantageously improves the responsiveness of release button 120 for releasing the bolt to reclose the breech, as further described below. At this stage in the firing cycle, the hammer 25 continues to hold the bold 50 rearward with the breech open.

Figure 29:
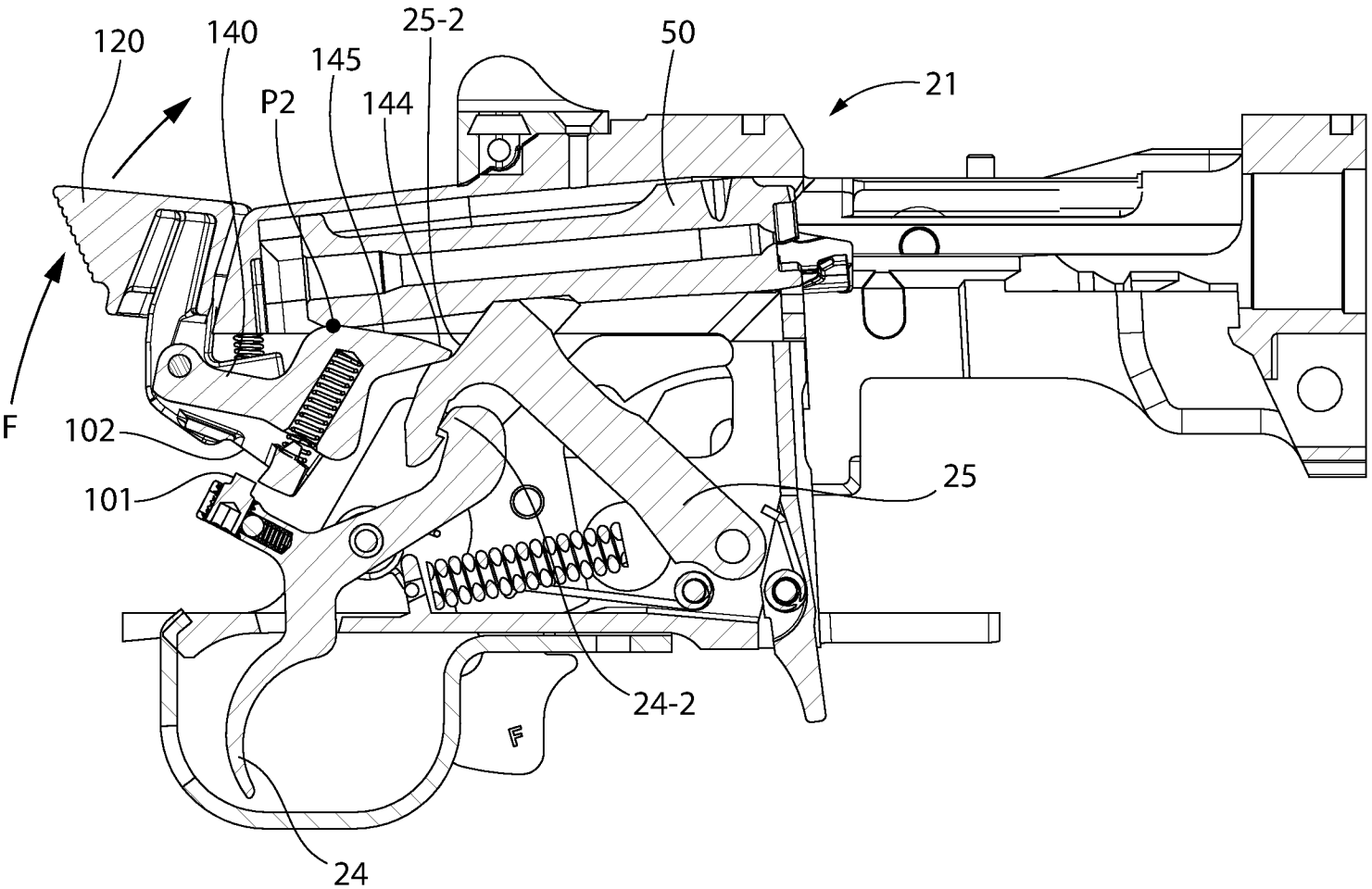
FIG. 29 is a fifth sequential view thereof.

The action shown in FIGS. 28 and 29 is currently in the locked rear position. In order to release the bolt 50 forward back into battery with the barrel to reclose the breech for firing the next round, the user must both: (1) release the trigger 24 to deactivate the trigger safety interlock to break engagement between trigger block protrusion 101 on the trigger with locking recess 102 of the bolt release mechanism 100; and then (2) manually actuate the bolt release mechanism 100.

FIG. 29 shows that the user has now released the trigger 24. This deactivates the trigger interlock safety such that trigger block protrusion 101 is now disengaged from locking recess 102 of the disconnect lever 140, thereby achieving step (1) above in the bolt release process. The also user starts to apply an upward applied force F via the thumb or finger on release button 120 which begins to move slightly upward as depicted in this figure. In the present application, force F designates any manually applied force by the user.

Figure 30:
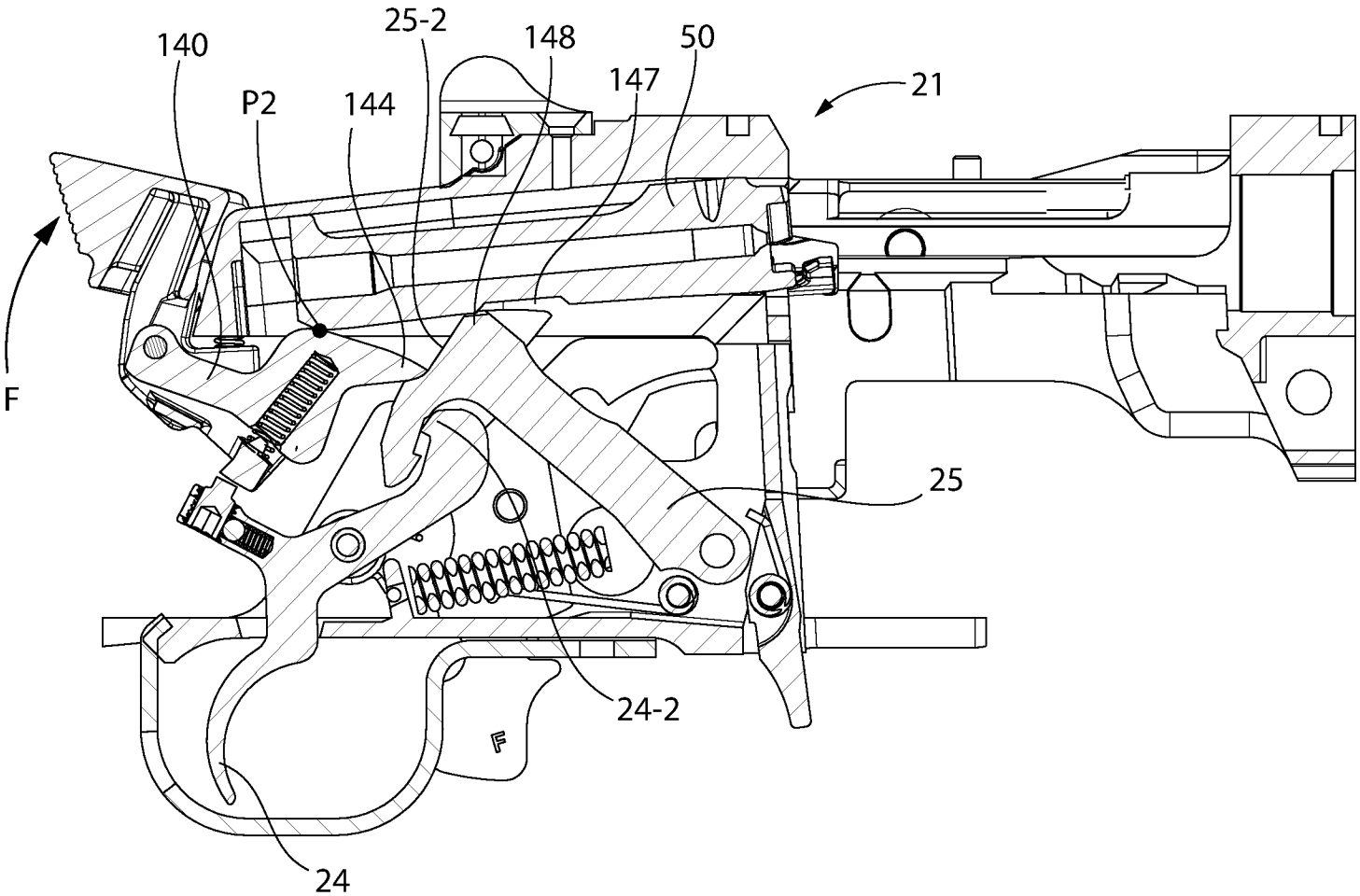
FIG. 30 is a sixth sequential view thereof.

In FIG. 30, the user now fully actuates the bolt release mechanism 100 by pushing release button 120 at the rear end of the receiver 21 farther upwards as shown by applied force F. This achieves step (2) above in the bolt release process. The user pushes the release button upwards until the front contact tip 144 of disconnect lever 140 rotates downward sufficiently to disengage the hammer 25 from bolt 50. Bolt catch protrusion 148 on hammer 25 disengages retention notch 147 on the bolt which frees and releases the bolt.

Figure 31:
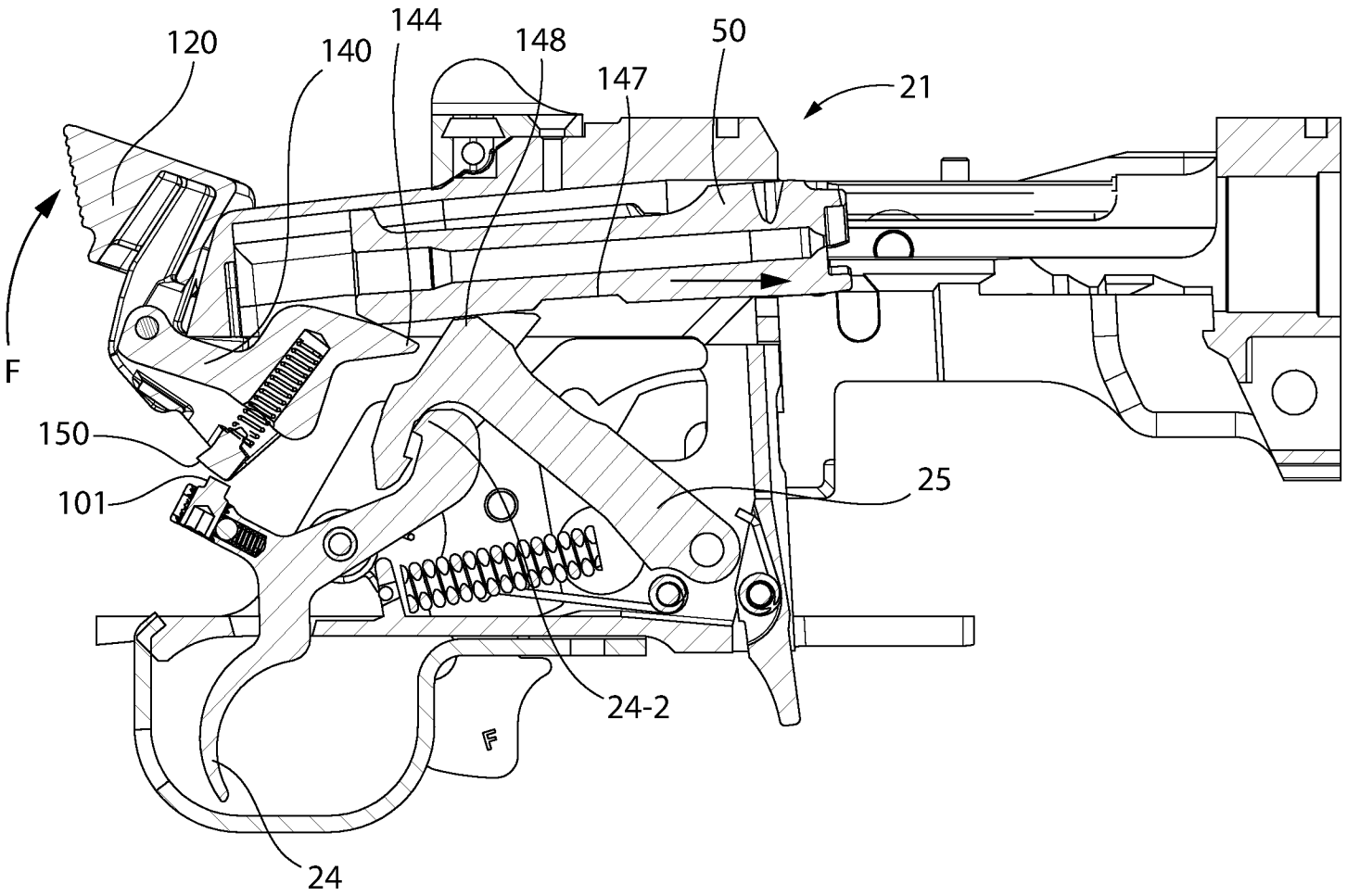
FIG. 31 is a seventh sequential view thereof.

FIG. 31 shows the released bolt 50 beginning to travel forward under the biasing action of spring-biased slide 108 to reclose the breech. The bolt will strip and chamber a fresh new cartridge from the magazine 33 during it return motion. The disconnect lever 140 begins to move back upwards under the biasing action of operating spring 136 and releases the hammer 25 to rotate upward and slideably engage the portion of bolt 50 behind the retention notch 147. Hammer 25 is now held downward/rearward by slideable engagement with the underside of bolt 50 alone (noting that the sear protrusion 24-2 of trigger 24 is not yet re-engaged with the hammer and disconnect lever 140 is completely disengaged from the hammer).

Figure 32:
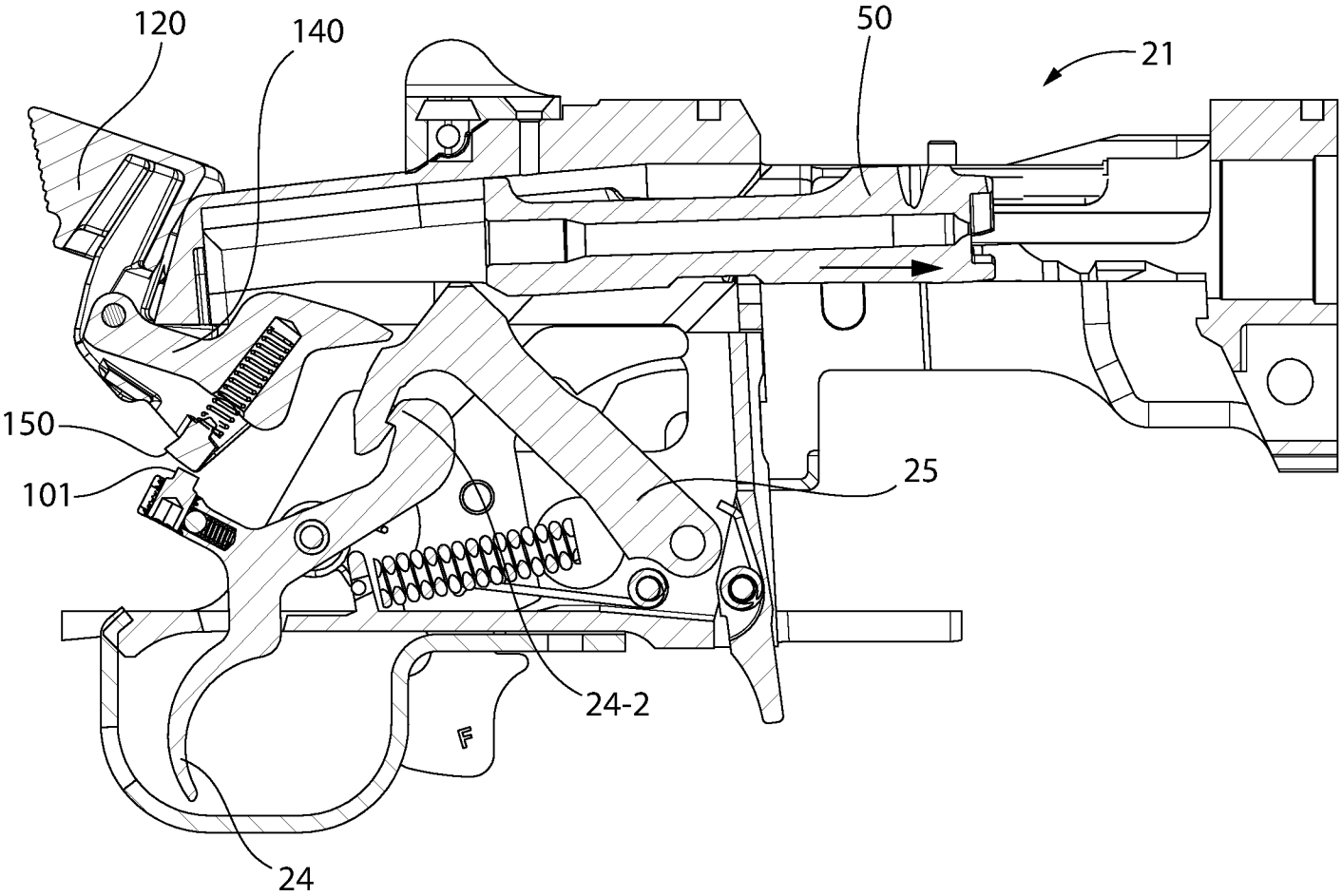
FIG. 32 is a eighth sequential view thereof.
Figure 33:
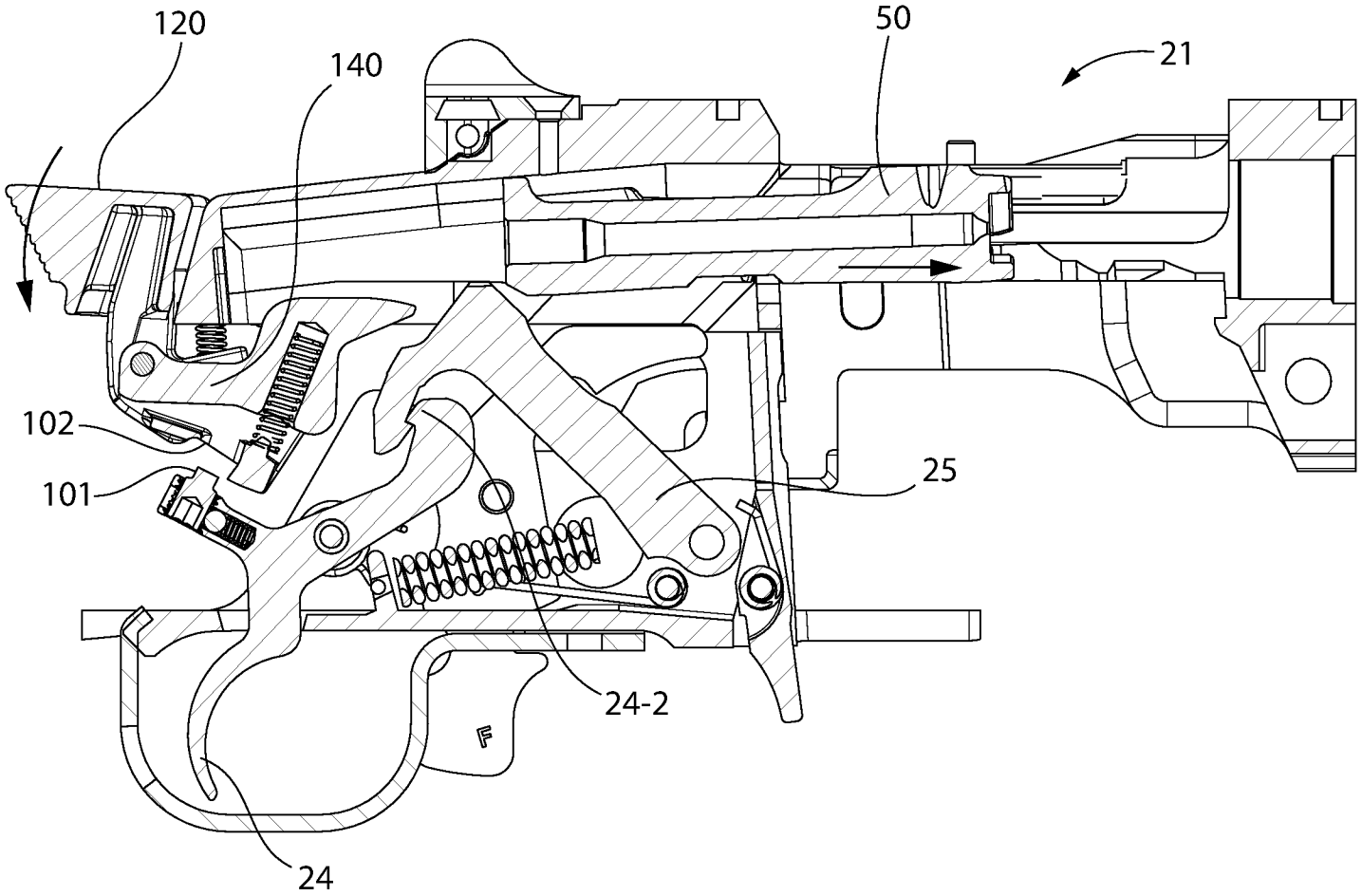
FIG. 33 is a ninth sequential view thereof.
Figure 34:
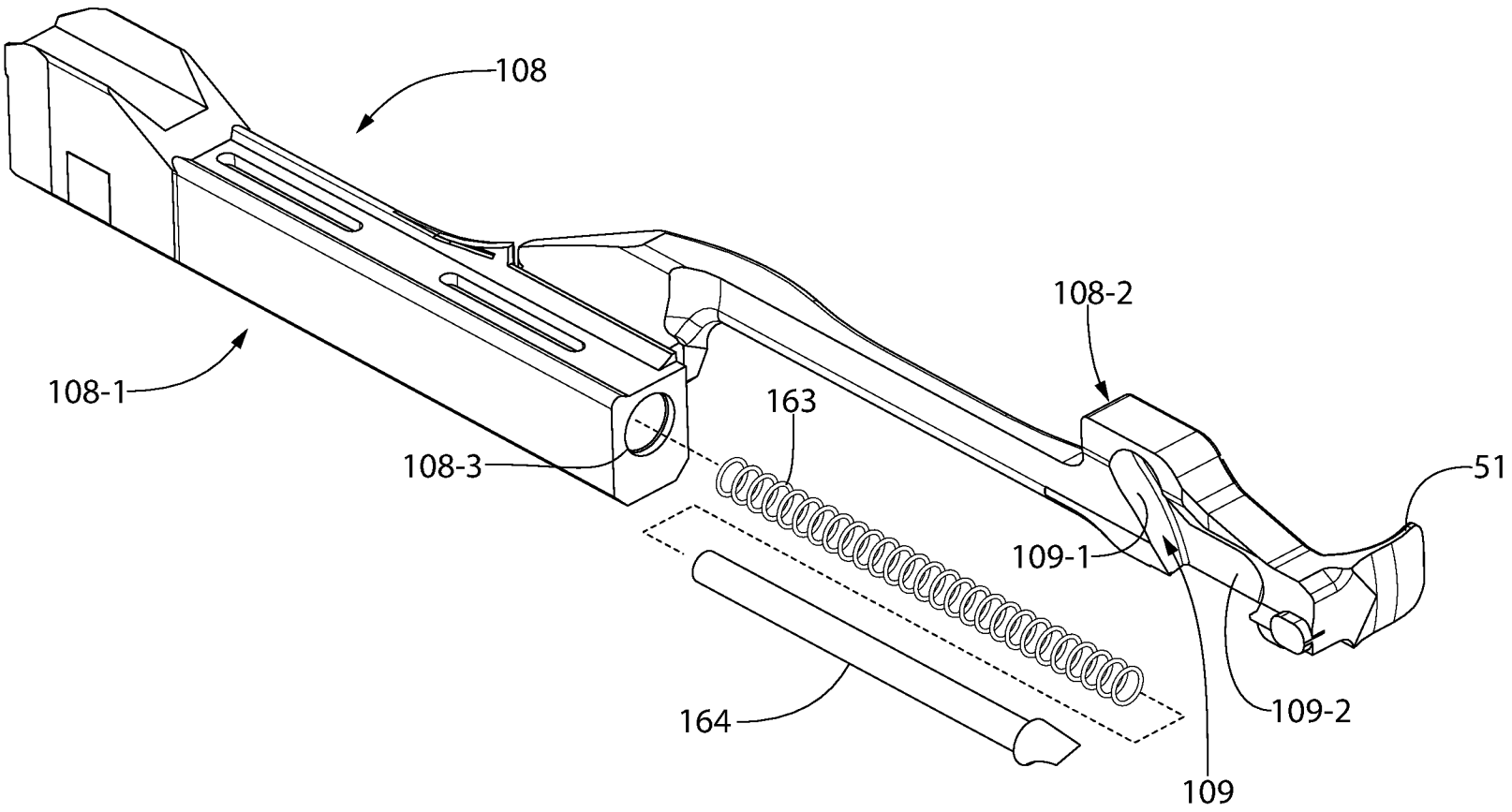
FIG. 34 is a perspective view of a bolt slide which cooperates with the bolt of the firearm to bias the bolt forward into battery with the barrel in a closed breech position.

In FIG. 32, the bolt 50 continues to travel forward to reclose the breech. The hammer 25 disengages the bolt and is therefore no longer held down so that the hammer can rotate upwards back into engagement with the primary sear protrusion 24-2 of the trigger 24. Notably, assuming that the user has not yet released the release button 120 which is therefore still in in the upward actuated position, a second aspect of the trigger interlock safety is now activated. Downward facing blocking surface 150 on release button 120 is now vertically aligned with and positioned over to engage trigger block protrusion 101 of trigger 24 as shown if an attempt is made to pull the trigger (still in its forward unpulled state). The trigger 24 thus cannot be actuated until the release button is released, which will then reposition the blocking surface 150 forward of the trigger block protrusion 101 and vertically realign (but not engage) the trigger block protrusion with the locking recess 102 (see, e.g. FIG. 33). Once the user releases the release button 120 which is returned to its downward unactuated position under the biasing action of reset spring 134, the trigger may be pulled to fire the firearm and repeat the foregoing interrupted firing cycle starting with FIG. 25 again and a closed breech.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A firearm with interrupted action comprising:
a longitudinal axis;
a receiver defining a longitudinally-extending cavity;
a barrel supported by the receiver;
a trigger movably mounted to the receiver;
a bolt slideably mounted in the cavity of the receiver for movement between a forward position in battery with the barrel and a rearward position;
a cockable hammer operably interacting with the trigger, the hammer pivotably movable about a pivot axis between a rear cocked position and a forward fire position via pulling the trigger;
the hammer configured and operable to retain the bolt in the rearward position after a trigger pull to fire the firearm; and
a bolt release mechanism operably interacting with the bolt, the bolt release mechanism comprising a user-actuated release button and a spring-biased disconnect lever coupled to the release button;
wherein actuating the release button when the bolt is in the rearward position releases the bolt;
wherein the release button is axially aligned with the longitudinal axis of the firearm.

2. The firearm according to claim 1, further comprising a transversely oriented pivot pin pivotably coupling the disconnect lever to the release button.

3. The firearm according to claim 1, wherein the release button is movable upwards to an actuated position to release the bolt from its rearward position.

4. The firearm according to claim 3, further comprising a reset spring biasing the release button towards a downward unactuated position.

5. The firearm according to claim 1, wherein the trigger comprises a sear protrusion configured to directly engage and hold the hammer in the cocked position when the trigger is unpulled, and wherein pulling the trigger releases the hammer to discharge the firearm.

6. The firearm according to claim 1, wherein the disconnect lever comprises a travel stop which engages the receiver to limit an uppermost position of the disconnect lever.

7. A firearm with interrupted action comprising:
a longitudinal axis;
a receiver defining a longitudinally-extending cavity;
a barrel supported by the receiver;
a trigger movably mounted to the receiver;
a bolt slideably mounted in the cavity of the receiver for movement between a forward position in battery with the barrel and a rearward position;
a cockable hammer operably interacting with the trigger, the hammer pivotably movable about a pivot axis between a rear cocked position and a forward fire position via pulling the trigger;
the hammer configured and operable to retain the bolt in the rearward position after a trigger pull to fire the firearm; and
a bolt release mechanism operably interacting with the bolt, the bolt release mechanism comprising a user-actuated release button and a spring-biased disconnect lever coupled to the release button;
wherein actuating the release button when the bolt is in the rearward position releases the bolt;
wherein release button comprises an exposed actuating portion extending rearwardly from the rear of the receiver for engagement by the user to actuate the bolt release mechanism.

8. A firearm with interrupted action comprising:
a longitudinal axis;
a receiver defining a longitudinally-extending cavity;
a barrel supported by the receiver;
a trigger movably mounted to the receiver;
a bolt slideably mounted in the cavity of the receiver for movement between a forward position in battery with the barrel and a rearward position;
a cockable hammer operably interacting with the trigger, the hammer pivotably movable about a pivot axis between a rear cocked position and a forward fire position via pulling the trigger;
the hammer configured and operable to retain the bolt in the rearward position after a trigger pull to fire the firearm; and
a bolt release mechanism operably interacting with the bolt, the bolt release mechanism comprising a user-actuated release button and a spring-biased disconnect lever coupled to the release button;
wherein actuating the release button when the bolt is in the rearward position releases the bolt;
wherein the release button is movable upwards to an actuated position to release the bolt from its rearward position;
wherein moving the release button upwards rotates a forwardly extending working protrusion of the disconnect lever downwards which in turn directly engages and rotates the hammer downwards to release the bolt.

9. The firearm according to claim 8, wherein the working protrusion of the disconnect lever engages a top surface of the hammer to force the hammer downwards to release the bolt.

10. A firearm with interrupted action comprising:
a longitudinal axis;
a receiver defining a longitudinally-extending cavity;
a barrel supported by the receiver;
a trigger movably mounted to the receiver;
a bolt slideably mounted in the cavity of the receiver for movement between a forward position in battery with the barrel and a rearward position;
a cockable hammer operably interacting with the trigger, the hammer pivotably movable about a pivot axis between a rear cocked position and a forward fire position via pulling the trigger;
the hammer configured and operable to retain the bolt in the rearward position after a trigger pull to fire the firearm; and
a bolt release mechanism operably interacting with the bolt, the bolt release mechanism comprising a user-actuated release button and a spring-biased disconnect lever coupled to the release button;
wherein actuating the release button when the bolt is in the rearward position releases the bolt;
further comprising an operating spring arranged between the release button and the disconnect lever, the operating spring biasing the disconnect lever towards an upward position.

11. The firearm according to claim 10, wherein the disconnect lever is vertically positioned to at least partially enter the cavity of the receiver to engage the bolt when the bolt is in its rearward position.

12. The firearm according to claim 11, wherein when the bolt moves from the forward position to the rearward position with the disconnect lever in the upward position, the bolt pushes the disconnect lever downwards into engagement with the hammer which is held in the cocked position by the disconnect lever.

13. A firearm with interrupted action comprising:
a longitudinal axis;
a receiver defining a longitudinally-extending cavity;
a barrel supported by the receiver;
a trigger movably mounted to the receiver;
a bolt slideably mounted in the cavity of the receiver for movement between a forward position in battery with the barrel and a rearward position;
a cockable hammer operably interacting with the trigger, the hammer pivotably movable about a pivot axis between a rear cocked position and a forward fire position via pulling the trigger;
the hammer configured and operable to retain the bolt in the rearward position after a trigger pull to fire the firearm; and
a bolt release mechanism operably interacting with the bolt, the bolt release mechanism comprising a user-actuated release button and a spring-biased disconnect lever coupled to the release button;
wherein actuating the release button when the bolt is in the rearward position releases the bolt;
wherein the trigger comprises a trigger block protrusion selectively engageable with a locking recess on the bolt release mechanism, wherein the release button is not movable to release the bolt when the trigger block protrusion is engaged with the locking recess.

14. The firearm according to claim 13, wherein pulling the trigger engages the trigger block protrusion with the locking recess, and releasing the trigger disengages the trigger block protrusion from the locking recess.

15. The firearm according to claim 14, wherein the trigger block protrusion is independently moveable relative to a main body of the trigger to adjust engagement of the trigger block protrusion with the locking recess on the bolt release mechanism.

16. The firearm according to claim 13, wherein the locking recess is formed in the bottom of the release button and the trigger block protrusion is formed on a cantilevered rearward extension of the trigger.

17. A firearm with interrupted action comprising:
a longitudinal axis;
a receiver defining a longitudinally-extending cavity;
a barrel supported by the receiver;
a bolt slideably mounted in the cavity of the receiver for movement between a forward position in battery with the barrel and a rearward position;
a hammer pivotably movable about a pivot axis between a rear cocked position and a forward fire position, the hammer operably engageable with the bolt after firing the firearm to retain the bolt in the rearward position;
a trigger comprising a sear protrusion operably engaged with the hammer to retain the hammer in the rear cocked position; and
a user-actuated bolt release mechanism configured to selectively engage the hammer;
wherein actuating the bolt release mechanism when the hammer is retaining the bolt in the rearward position rotates the hammer which releases the bolt;
wherein the bolt release mechanism comprises:
a user-actuated release button comprising an exposed actuating portion extending rearwardly from a rear end of the receiver; and
a spring-biased disconnect lever pivotably coupled to release button by a fixed primary pivot point, The disconnect lever extending forward from the release button for engaging the hammer;

wherein the release button is movable between a downward unactuated position and upward actuated position associated with releasing the bolt when the hammer is engaged with the bolt in its rearward position.

18. The firearm according to claim 17, wherein when the bolt moves from the forward position to the rearward position, the bolt engages and pushes the disconnect lever downwards into engagement with the hammer which is held in the cocked position by the disconnect lever.

19. The firearm according to claim 18, wherein the sear protrusion of the trigger is disengaged from the hammer when the hammer is held in the cocked position by the disconnect lever.

20. The firearm according to claim 18, wherein the disconnect lever comprises an arcuately curved top cam surface which engages a cam of the bolt to push the disconnect lever downwards.

21. The firearm according to claim 18, wherein moving the release button from the downward unactuated position to the upward actuated position while the bolt is engaged with the disconnect lever rotates the disconnect lever downward to displace the hammer which breaks engagement with and releases the bolt forward.

22. The firearm according to claim 21, wherein the engagement between the bolt and disconnect lever defines a transient secondary pivot point about which the disconnect lever rotates downward while the bolt is in its rearward position.

23. The firearm according to claim 17, wherein the trigger and hammer are mounted in a separate removable trigger housing detachably coupled to the receiver, and the bolt release mechanism is mounted to a rear end of the receiver.

24. A firearm with interrupted action comprising:

a longitudinal axis;

a receiver defining a longitudinal cavity;

a barrel supported by the receiver;

a bolt slideably movable in the longitudinal cavity of the receiver between a forward position in battery with the barrel and a rearward position;

a trigger operable to fire the firearm;

a hammer pivotably movable about a pivot axis between a rear cocked position and a forward fire position, the hammer operably engageable with the bolt after firing the firearm to retain the bolt in the rearward position;

a user-actuated bolt release mechanism configured to selectively engage the hammer;

the bolt release mechanism comprising a user-actuated release button and a disconnect lever operably interacting with the hammer;

an operating spring biasing the disconnect lever into an upward position protruding at least partially into the longitudinal cavity of the receiver;

wherein when the bolt moves from the forward position to the rearward position, the bolt engages and pushes the disconnect lever downwards into engagement with the hammer which is held in the cocked position by the disconnect lever;

wherein actuating the bolt release mechanism when the hammer is retaining the bolt in the rearward position rotates the hammer which releases the bolt.

25. The firearm according to claim 24, wherein the disconnect lever comprises an arcuately curved top cam surface which engages a rounded or angled cam of the bolt which pushes the disconnect lever downwards.

26. The firearm according to claim 24, wherein the release button comprises an exposed rear actuating portion extending rearwardly from a rear end of the receiver for engagement by the user, and a coupling portion extending forwardly therefrom inside the receiver.

27. The firearm according to claim 26, further comprising a pivot pin which pivotably couples the forward coupling portion of the release button to a cantilevered rear mounting leg of the disconnect lever.

28. The firearm according to claim 26, wherein the rear actuating portion of the release button is in axial alignment with the longitudinal axis of the firearm.

29. The firearm according to claim 26, wherein the rear actuating portion comprising a rear downwardly angled actuating surface arranged for engagement by user's thumb to actuate the bolt release mechanism.

30. The firearm according to claim 24, wherein pushing the release button upwards actuates the bolt release mechanism.

31. The firearm according to claim 24, wherein the release button comprises a transversely spaced apart pair of mounting arms which are pivotably coupled to a rear end of the receiver for upward and downward movement of the release button to actuate the bolt release mechanism.

32. The firearm according to claim 24, wherein the longitudinal cavity of the receiver slopes downwardly to the rear which guides the bolt into a position obliquely angled to the longitudinal axis of the firearm to engage the bolt with the disconnect lever of the bolt release mechanism when the bolt is in the rearward position.

* * * * *